US009821237B2

(12) United States Patent
Vasquez

(10) Patent No.: US 9,821,237 B2
(45) Date of Patent: Nov. 21, 2017

(54) CHARACTER-BASED ELECTRONIC DEVICE, SYSTEM, AND METHOD OF USING THE SAME

(71) Applicant: Tito Vasquez, Findlay, OH (US)

(72) Inventor: Tito Vasquez, Findlay, OH (US)

( * ) Notice: Subject to any disclaimer, the term of this patent is extended or adjusted under 35 U.S.C. 154(b) by 0 days.

(21) Appl. No.: 14/255,997

(22) Filed: Apr. 18, 2014

(65) Prior Publication Data

US 2014/0315468 A1 Oct. 23, 2014

Related U.S. Application Data

(60) Provisional application No. 61/814,262, filed on Apr. 20, 2013.

(51) Int. Cl.
*A63F 9/00* (2006.01)
*A63H 13/02* (2006.01)

(52) U.S. Cl.
CPC ..... *A63H 13/02* (2013.01)

(58) Field of Classification Search
None
See application file for complete search history.

(56) References Cited

U.S. PATENT DOCUMENTS 4,298,915 A * 11/1981 Goldfarb ..... F21L 11/00 362/124
5,334,073 A * 8/1994 Tilbor ..... A63H 3/16 273/380
6,071,166 A * 6/2000 Lebensfeld ..... A63F 9/0291 446/175
6,652,351 B1 * 11/2003 Rehkemper ..... A63H 13/02 446/312
6,776,681 B2 * 8/2004 Willett ..... A63H 3/48 446/298
6,802,382 B2 * 10/2004 Hattori ..... B62D 57/032 180/8.6
7,244,183 B1 * 7/2007 England ..... A63F 9/02 446/175
7,627,935 B1 * 12/2009 Ostrum ..... A61G 17/08 27/1
7,731,560 B2 * 6/2010 Kratz ..... A63H 11/10 446/354
8,157,612 B2 * 4/2012 Rehkemper ..... A63H 13/04 446/331
8,358,286 B2 1/2013 Cannon
8,475,275 B2 7/2013 Weston et al.
2001/0051488 A1 12/2001 Tachau et al.
(Continued)

FOREIGN PATENT DOCUMENTS

WO 2009010760 1/2009
WO 2010021592 2/2010

*Primary Examiner* — Seng H Lim
(74) *Attorney, Agent, or Firm* — Ward Law Office LLC; Jacob M. Ward

(57) ABSTRACT

Character-based electronic devices, systems, and methods of using the same are described. More particularly, character-based electronic devices having an actuator are described. An exemplary character-based electronic device comprises a housing, an actuator, a communication bus (e.g., USB hub), a component, and a light source. The component is attached to the communication bus and the actuator such that movement of the actuator relative to the housing alters a condition of the component.

4 Claims, 10 Drawing Sheets

(56) References Cited

U.S. PATENT DOCUMENTS

2002/0164922 A1* 11/2002 Willett ..... A63H 3/48 446/330
2005/0059483 A1* 3/2005 Borge ..... A63F 13/02 463/29
2006/0128447 A1* 6/2006 Tischer ..... H04B 1/3833 455/575.1
2006/0292965 A1* 12/2006 Strauss ..... A63H 3/20 446/376
2007/0042672 A1 2/2007 Tawil
2007/0093172 A1* 4/2007 Zheng ..... A63H 3/28 446/268
2007/0149089 A1* 6/2007 De La Torre ..... A63H 3/20 446/373
2007/0256547 A1* 11/2007 Feeney ..... A63H 5/00 84/615
2008/0014829 A1 1/2008 Dyer et al.
2008/0026669 A1* 1/2008 Rehkemper ..... A63H 3/28 446/301
2008/0153594 A1* 6/2008 Zheng ..... A63H 3/36 463/39
2009/0018841 A1* 1/2009 Leeds ..... A63H 3/28 704/272
2010/0003888 A1* 1/2010 Massaro ..... A63H 3/24 446/130
2010/0041304 A1 2/2010 Eisenson
2010/0099493 A1 4/2010 Horovitz
2011/0001892 A1 1/2011 Gay
2011/0009175 A1* 1/2011 Raichman ..... A63H 3/36 463/1
2011/0047600 A1 2/2011 Johnson et al.
2012/0214589 A1 8/2012 Dixon et al.
2012/0295704 A1 11/2012 Reiche et al.
2013/0104040 A1 4/2013 Birnbaum et al.
2013/0124277 A1 5/2013 Dooley et al.
2013/0237123 A1* 9/2013 Rucker ..... A63H 13/02 446/330
2014/0038489 A1* 2/2014 Sharma ..... A63H 30/04 446/175
2014/0349547 A1* 11/2014 Fife ..... A63H 30/04 446/353

* cited by examiner

CHARACTER-BASED ELECTRONIC DEVICE, SYSTEM, AND METHOD OF USING THE SAME

PRIORITY/CROSS-REFERENCE TO RELATED APPLICATIONS

This application claims the benefit of U.S. Provisional Application No. 61/814,262, filed on Apr. 20, 2013. The disclosure of this related application is hereby incorporated into this disclosure in its entirety.

DETAILED DESCRIPTION

The following detailed description and the appended drawings describe and illustrate various example embodiments of character-based electronic devices, systems, and methods of using the same. The description and drawings are exemplary in nature and are provided to enable one skilled in the art to make one or more exemplary character-based electronic devices, systems, and practice one or more methods of using a character-based electronic device. They are not intended to limit the scope of the claims in any manner.

The use of "e.g.," "etc.," "for instance," "in example," and "or" and grammatically related terms indicate non-exclusive alternatives without limitation, unless otherwise noted. The use of "optionally" and grammatically related terms means that the subsequently described element, event, feature, or circumstance may or may not be present or occur, and that the description includes instances where said element, event, feature, or circumstance occurs and instances where it does not. The use of "exemplary" refers to "an example of" and is not intended to convey a meaning of an ideal or preferred embodiment.

The use of "attached" refers to the fixed, releasable, or integrated association of two or more elements, components, and/or devices, and includes fixing, releasably attaching, or integrally associating two or more elements, components, and/or devices electronically using one or more means for transferring signals (e.g., coaxial cables, wires, copper wires, conductors, fiber optics, bus configurations, acoustic waves, light waves, switches, electrical contacts) such that the elements, components, and/or devices can communicate with one another. Thus, the term "attached" includes releasably attaching or fixedly attaching two or more elements, components, and/or devices.

The term "character" means a representation or structural configuration that forms a symbol, animal, person that is real or fictional, human figure, character that is real or fictional, fictional figure, figure, action figure, ornamental figure, figurine, brand, characterized figure, ornamental configuration, and the like.

The term "communication bus" means any element, component, device, or system that can transfer data and/or signals (e.g., control, electrical, data) between the communication bus and/or other elements, components, devices, and/or systems, including elements, components, devices, and systems that are directly or indirectly attached to the communication bus.

The term "synch" means that a first device, component, or system is connected or attached to a second device, component, or system such that the synchronization of one or more processes and/or the synchronization of data can be accomplished between the first device, component, or system and second device, component, or system.

Figure 1:
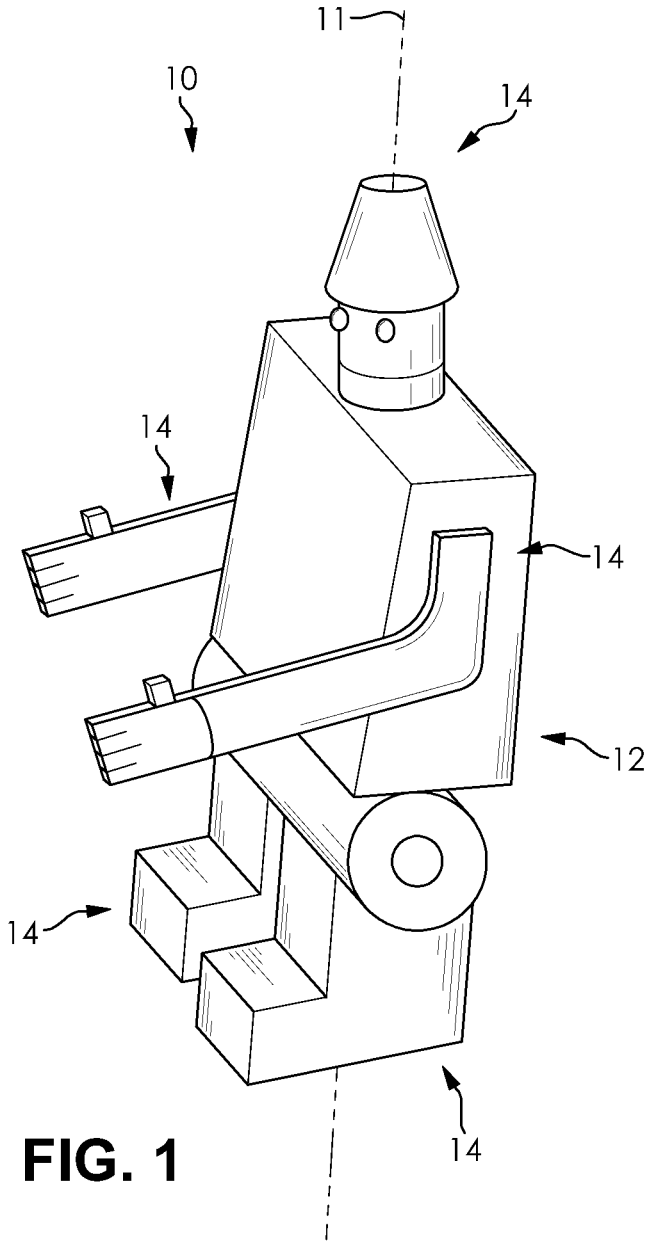
FIG. 1 is a perspective view of a character-based electronic device.
Figure 2:
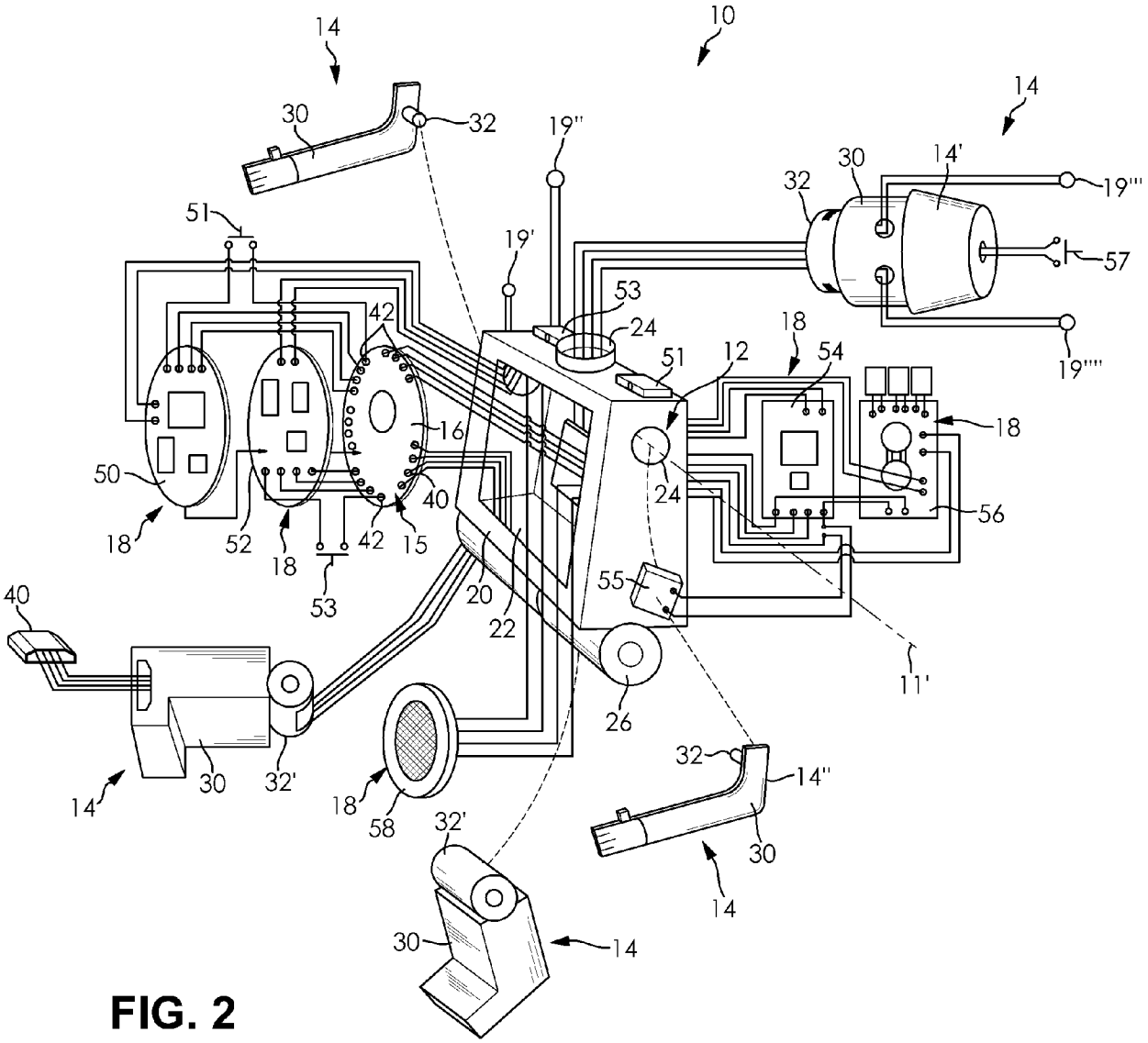
FIG. 2 is an exploded schematic view of the character-based electronic device illustrated in FIG. 1.

FIGS. 1 and 2 illustrate a character-based electronic device 10 that comprises a lengthwise axis 11, a housing 12, a plurality of actuators 14, a communication bus 15 (e.g., universal serial bus (USB) hub 16), a plurality of components 18, and a plurality of light sources 19. Character-based electronic device 10 has a structural arrangement that forms a character.

FIG. 2 illustrates an exemplary communication bus 15 that is adapted to be used in the character-based electronic devices, systems, and methods described herein. It is to be understood, however, that any suitable communication bus having any suitable structure or configuration can be used in a character-based electronic device, system, and/or method. Skilled artisans will be able to select a suitable communication bus to include in a character-based electronic device, system, and/or method according to a particular embodiment based on various considerations, including the desired functionality of a character-based electronic device, system, or method. Example communication buses considered suitable to include in a character-based electronic device, system, and/or method include USB hubs, and any other element, device, or system considered suitable for a particular application. In the illustrated embodiment, an example of a suitable communication bus 15 is USB-hub 16, as described in more detail herein.

Housing 12 and each actuator of the plurality of actuators 14 can be formed of any suitable material and using any suitable method of manufacture. Skilled artisans will be able to select a suitable material and method of manufacture to form a housing and/or an actuator according to a particular embodiment based on various considerations, including the desired components intended to be included with a character-based electronic device. Example materials considered suitable to form a housing and/or actuator include, but are not limited to, metals, plastics, polymers, and any other material considered suitable for a particular embodiment.

Example methods of manufacture considered suitable to form a housing and/or an actuator include, but are not limited to, injection molding, and any other method of manufacture considered suitable for a particular embodiment.

Housing 12 and each actuator of the plurality of actuators 14 can have any suitable structural arrangement. Skilled artisans will be able to select a suitable structural arrangement for a housing, actuator, or plurality of actuators, according to a particular embodiment based on various considerations, including the desired assembled structural configuration of a character-based electronic device. Example structural arrangements considered suitable to form a housing and/or actuator include, but are not limited to, structural arrangements that form a part, portion, or the entirety of a character, such as a body part, appendage, head, arm, leg, midsection, waist, thorax, tail, accessory of a character, weapon, hair, shoe, clothing, and any other structural configuration considered suitable for a particular application.

In the illustrated embodiment, housing 12 comprises a housing wall 20 that defines a housing cavity 22, a plurality of housing openings 24, and a housing shaft 26. In FIG. 2, an opening on the front and back of the housing 12 has been illustrated for clarity. Housing 12 is formed as a first portion of a character. Housing cavity 22 extends into housing 12 and is sized and configured to house a portion, or the entirety, of USB hub 16, each component of the plurality of components 18, and each light source of the plurality of light sources 19. Each opening of the plurality of housing openings 24 extends through the housing wall 20 and provides access to housing cavity 22. Housing shaft 26 is attached to an exterior surface of housing 12 and is configured such that one or more actuators (e.g., an actuator that defines a part of a character, an actuator that defines a portion of a character, an actuator that defines the entirety of the character, body part, appendage, head, arm, leg, midsection, waist, thorax, tail, accessory of a character, weapon, hair, shoe, clothing) can be attached to the housing shaft 26. Optionally, housing shaft 26 can be omitted from housing 12 and one or more actuators can be attached directly to housing 12. Optionally, in embodiments that include an opening on the front and/or back of a housing, one or more lids can be included that can be attached to a housing wall.

Alternative to the structural arrangement illustrated in FIGS. 1 and 2, a housing can comprise a first portion that is attached to a second portion. For example, the first portion and second portion can cooperatively define a housing cavity. Alternatively, the first portion or the second portion can define a housing cavity. Optionally, a housing, or an actuator, can define one or more openings such that sound waves can be emitted from a speaker disposed within a cavity defined by the housing or actuator to an environment exterior to the cavity or such that sound waves can be transferred to a microphone disposed within the cavity from an environment exterior to the cavity.

In the illustrated embodiment, each actuator of the plurality of actuators 14 is moveably attached to housing 12 and comprises an actuator body 30. A first set of actuators of the plurality of actuators 14 defines a protuberance 32 that is sized and configured to be disposed within an opening of the plurality of openings 24 and a second set of actuators of the plurality of actuators defines a protuberance 32' that is sized and configured to be attached to housing shaft 26. The second set of actuators can be attached to a housing shaft 26 using any suitable technique and structure. For example, a rod can be inserted through an opening defined by the shaft 26 and each actuator of the plurality of actuators 14 that is intended to be attached to the shaft 26.

Each actuator of the plurality of actuators 14 is formed as another portion of the character that is different than the first portion formed by the housing 12. Alternatively, one or more actuators can be formed as a portion of the character that is the same as the portion formed by the housing. Each actuator of the plurality of actuators 14 is moveable relative to housing 12 between a first position, second position, and/or a position between the first position and the second position. In the illustrated embodiment, each actuator of the plurality of actuators 14 is a single contiguous component.

Each actuator of the plurality of actuators 14 can comprise any suitable structure that is capable of moving between a first position, second position, and/or a position between the first position and the second position. Skilled artisans will be able to select a suitable structure according to a particular embodiment based on various considerations, including the structural arrangement of a housing. Example structures considered suitable for an actuator include, but are not limited to, a manual actuator, electrical actuator, structures that form a button, spring-loaded button, knob, touch screen sensor, a part of a character, a portion of a character, the entirety of a character, appendage, body part, head, arm, leg, midsection, waist, thorax, tail, accessory of a character, weapon, hair, shoe, clothing, and any other structure considered suitable for a particular embodiment.

Movement between each an actuator of the plurality of actuators 14 relative to housing 12 can be accomplished in any suitable manner, and skilled artisans will be able to select a suitable type of movement between an actuator relative to a housing based on various considerations including the type of attachment between an actuator and a housing. Example types of movement considered suitable between an actuator relative to a housing include, but are not limited to, angular movement, rotational movement, linear movement, and any other type of movement considered suitable for a particular application. As described in more detail herein, as each actuator of the plurality of actuators 14 is moved between the first position, second position, and/or a position between the first position and the second position, the condition of a component of the plurality of components 18 that is attached to, or in communication with, an actuator of the plurality of actuators 14 is altered. Thus, movement of an actuator of the plurality of actuators 14 alters a condition of an associated component of the plurality of components 18. Optionally, an actuator can alter the state of one, at least one, two, three, four, or any other suitable number of components.

While each actuator of the plurality of actuators 14 has been illustrated as attached to housing 12 using a protuberance 32 disposed through an opening of the plurality of openings 24 or protuberance 32' attached to housing shaft 26, any suitable type of moveable attachment between an actuator and a housing can be used. Skilled artisans will be able to select a suitable type of attachment between an actuator and a housing according to a particular embodiment based on various considerations, including the material(s) forming an actuator and/or housing. Examples of suitable types of attachment between an actuator and a housing include, but are not limited to, positioning a portion, or the entirety, of an actuator within a slot, or opening, defined by the housing, placing a protuberance defined by a housing within a cavity, or opening, defined by an actuator, and any other form of attachment considered suitable for a particular embodiment.

While a plurality of actuators 14 has been illustrated, a character-based electronic device can include any suitable number of actuators. Skilled artisans will be able to select a suitable number of actuators to include in a character-based electronic device based on various considerations, including the number of components included in the character-based electronic device, the total number of appendages the character has, and the total number of accessories included with the character. Example number of actuators considered suitable include, but are not limited to, one, at least one, two, a plurality, three, four, five, six, and any other number considered suitable for a particular embodiment.

While each actuator of the plurality of actuators 14 has been illustrated as a single contiguous component, an actuator can comprise multiple components attached to one another such that movement between a first component relative to a second component can be accomplished. Skilled artisans will be able to select a suitable number of components to form an actuator based on various considerations, including the desired flexibility of the actuator. Example number of components considered suitable include, but are not limited to, one, at least one, two, a plurality, three, four, five, six, and any other number considered suitable for a particular embodiment. Optionally, if a multi-component actuator is included in a character-based electronic device, movement of one, or more than one, of the components of the multi-component actuator between a first position, second position, and/or a position between the first position and the second position, can alter the condition of a component attached to the multi-component actuator.

While each actuator of the plurality of actuators 14 has been illustrated as moveably attached to housing 12, any suitable number of actuators can be moveably attached to a housing of a character-based electronic device. Example number of actuators considered suitable to moveably attach to a housing include one, at least one, two, a plurality, three, four, five, six, seven, eight, and any other number considered suitable for a particular embodiment.

In the illustrated embodiment, USB hub 16 is disposed entirely within cavity 22 defined by housing 12 and can comprise a self-powered hub or a bus-powered hub. USB hub 16 comprises an upstream port 40 and a plurality of downstream ports 42. Upstream port 40 is adapted to attach USB hub 16 to another device or component, such as a computer, special purpose computer, USB hub, or any other device considered suitable for a particular application, such as those described herein. Each port of the plurality of downstream ports 42 is adapted to attach a component (e.g., a component of the plurality of components 18) to USB hub 16. Alternatively, a USB hub can be at least partially, or partially, disposed within a cavity defined by a housing.

While the communication bus 15 in the embodiments illustrated herein is illustrated as a USB hub 16, any suitable communication bus can be used. A skilled artisan will be able to select a suitable communication bus for a character-based electronic device according to a particular embodiment based on various considerations, including the size of a cavity defined by a housing or actuator, the desired functionality of the character-based electronic device, the number of components intended to be attached to the communication bus, and the number of actuators intended to be included in the character-based electronic device. Examples of suitable communication buses include, but are not limited to, bus-powered USB hubs, self-powered USB hubs, root hubs, USB 1.0 hubs, USB 2.0 hubs, USB 3.0 hubs, and any other USB hub considered suitable for a particular application.

In the illustrated embodiment, upstream port 40 comprises a male standard Type-A USB port and each port of the plurality of downstream ports 42 comprises a female standard Type-A port. Upstream port 40 is disposed within an opening defined by the wall of an aperture 14 that is rotatably attached to shaft 26. While particular structures have been illustrated and described with respect to upstream port 40 and each port of the plurality of downstream ports 42, any suitable structure can be used to attach a communication bus (e.g., USB hub) to another device or component, or to attach a device or component to a communication bus (e.g., USB hub). Skilled artisans will be able to select a suitable structure according to a particular embodiment based on various considerations, including the number of upstream ports included in a character-based electronic device. Example structures considered suitable include, but are not limited to, male and/or female USB Type-A ports, USB Type-B ports, USB mini-A ports, USB mini-B ports, and any other structure considered suitable for a particular embodiment.

While an upstream port 40 and a plurality of downstream ports 42 have been illustrated, a communication bus (e.g., USB hub) can include any suitable number of upstream and/or downstream ports. Skilled artisans will be able to select a suitable number of upstream ports and/or downstream ports to include on a communication bus (e.g., USB hub) according to a particular embodiment based on various considerations including the number of components intended to be included in a character-based electronic device. Example number of upstream ports and/or downstream ports considered suitable include but are not limited to, one, at least one, two, a plurality, three, four, five, six, seven, eight, and any other number considered suitable for a particular embodiment.

In the illustrated embodiment, each component of the plurality of components 18 is disposed entirely, or at least partially, within cavity 22 defined by housing 12 and is attached to USB hub 16 using a downstream port of the plurality of downstream ports 42. Thus, each component of the plurality of components 18 is attached to USB hub 16. In addition, each component of the plurality of components 18 is attached to an actuator of the plurality of actuators 14, as described in more detail below. Alternative to the USB hub and each component of the plurality of components being disposed within a cavity defined by a housing, a component can be housed within a cavity defined by an actuator and attached to a communication bus (e.g., USB hub) disposed within the cavity defined by the actuator or within a cavity defined by a housing or another actuator.

A first component of the plurality of components 18 is a wireless network adapter 50. A second component of the plurality of components 18 is a Bluetooth adapter 52. A third component of the plurality of components 18 is a memory flash card 54. A fourth component of the plurality of components 18 is a voice recorder 56 that is attached to memory flash card 54 and comprises a speaker 58 that produces sound waves and a microphone that obtains sound waves. Wireless network adapter 50, Bluetooth adapter 52, memory flash card 54, and/or voice recorder 56 can comprise any suitable structure that can attach, or is adapted to attach, to communication bus 8, such as USB hub 16 in the illustrated embodiment. For example, each component of the plurality of components 18 can include a male Type-A port.

While particular components have been illustrated, a character-based electronic device can include any suitable component and skilled artisans will be able to select a suitable component for a character-based electronic device according to a particular embodiment based on various considerations, including the desired functionality of the character-based electronic device. Example components considered suitable to include in a character-based electronic device include one or more wireless network adapters, Bluetooth adapters, computer readable media, data storage devices, memory flash cards, voice recorders, speakers, microphones, near field communication devices, radio frequency identification devices (RFID) (e.g., RFID tags), one or more energy storage devices (e.g., any device capable of storing energy and providing energy to any device or component described herein, the communication bus 15, USB hub 16, one or more components 18, plurality of light sources 19), power source used individually or as an interconnected group (e.g., batteries, single use batteries, rechargeable batteries, ultracapacitors), and any other device considered suitable for a particular application.

A first switch 51 is disposed between wireless network adapter 50 and USB hub 16 and is adapted to change a condition of wireless network adapter 50 (e.g., on, off). A second switch 53 is disposed between Bluetooth adapter 52 and USB hub 16 and is adapted to change a condition of Bluetooth adapter 52 (e.g., on, off). A third switch 55 is disposed between the memory flash card 54 and USB hub 16 and is adapted to change a condition of memory flash card 54 (e.g., on, off). A fourth switch 57 is disposed between voice recorder 56 and memory flash card 54 and is adapted to change a condition of voice recorder 56 (e.g., on, off).

In the illustrated embodiment, each of the first switch 51, second switch 53, and fourth switch 57 is attached to a first actuator 14' of the plurality of actuators 14 and third switch 55 is attached to a second actuator 14" of the plurality of actuators 14. Each component of the plurality of components 18 has at least a first condition and a second condition. Each condition of a component of the plurality of components 18 is based on a position of its associated switch, which is based on the position of its associated actuator of the plurality of actuators 14. Therefore, movement of an actuator between a first position, a second position, and/or a position between the first position and the second position, alters the condition of an associated component. A component can have any suitable number of conditions and any suitable type of condition. Example number of conditions considered suitable for a component include, but are not limited to, one, at least one, two, a plurality, three, and any other number considered suitable for a particular application. Conditions considered suitable for a component include, but are not limited, to an on condition, off condition, an intensity level, combinations of those described herein, and any other condition considered suitable for a particular application. Alternative to each switch being attached to an actuator of the plurality of actuators 14, each switch can be formed between housing 12 and an actuator of the plurality of actuators 14 using one or more electrical contacts.

Wireless network adapter 50 can comprise any suitable device capable of connecting character-based electronic device 10, communication bus 15 (e.g., USB hub 16), a component of the plurality of components 18, and/or any other device, to a network (e.g., local area network (LAN), wireless local area network (WLAN)). Bluetooth adapter 52 can comprise any suitable device capable of connecting electronic device 10, communication bus 15 (e.g., USB hub 16), a component of the plurality of components 18, and/or any other device, to another device (e.g., mobile device, cellular phone, computer, computing system, laptop, tablet, network). For example, a Bluetooth adapter can be adapted to transmit data to a device (e.g., mobile device, cellular phone, computer, computing system, laptop, tablet, network) and receive data from another device (e.g., mobile device, cellular phone, computer, computing system, laptop, tablet, network). Voice recorder 56 can comprise any suitable device capable of at least obtaining data relating to sound waves and transferring that data to a data storage device (e.g., memory flash card 54) and/or another component such that the data can be played as sound waves (e.g., speaker 58).

Memory flash drive 54 can comprise any suitable data storage device having any suitable capacity and comprising any suitable type of computer readable media, and skilled artisans will be able to select a suitable data storage device according to a particular embodiment based on various considerations, including the structural arrangement of a housing. Example capacities considered suitable for a data storage device include, but are not limited to, 8 gigabytes (GB), 16 GB, any capacity between about 8 GB to about 1 terabyte (TB), and any other capacity considered suitable for a particular embodiment.

Alternative to including a memory flash card 54, a character-based electronic device can include other types of data storage devices. Example data storage devices considered suitable to include in a character-based electronic device include computer readable media, random access memory (RAM), dynamic storage devices (e.g., dynamic RAM (DRAM), static RAM (SRAM), synchronous DRAM (SDRAM), flash RAM) for storing information and instructions, read only memory (ROM) or other static storage devices (e.g., programmable ROM (PROM), erasable PROM (EPROM), and electrically erasable PROM (EEPROM)) for storing information and instructions, storage devices (e.g., hard drive, floppy drive, magnetic disk, flash disk, optical disk), and any other data storage device considered suitable for a particular embodiment.

Each light source of the plurality of light sources 19 is attached to communication bus 15 (e.g., USB hub 16) and/or one or more components of the plurality of components 18. Each light source of the plurality of light sources 19 is adapted to indicate a condition of a component of the plurality of components 18 by providing constant illumination or by switching between an on and off condition (e.g., flashing). Each light source 19 of the plurality of light sources can be disposed within an opening defined by housing 12, an actuator of the plurality of actuators 14, exterior to housing 12 or an actuator of the plurality of actuators 14, or disposed within housing 12 or an actuator of the plurality of actuators 14. Each light source of the plurality of light sources 19 can comprise any suitable structure capable of illumination, and skilled artisans will be able to select a suitable structure according to a particular embodiment based on various considerations, including the type of device or component attached to the light source. Example light sources considered suitable include, but are not limited to, light emitting diodes (LEDs), optical fibers with or without cladding, and any other light source considered suitable for a particular embodiment.

A light source can emit light having any suitable color, and skilled artisans will be able to select a suitable color for a light source to emit according to a particular embodiment based on various considerations, including the structural arrangement of the character-based electronic device. Example colors considered suitable for a light source to emit include, but are not limited to, red, blue, green, white, yellow, and any other color considered suitable for a particular embodiment.

In use, rotational movement of the first actuator 14' of the plurality of actuators 14 about lengthwise axis 11 alters the condition of the either the wireless network adapter 50 or the Bluetooth adapter 52. For example, if the first actuator 14' of the plurality of actuators 14 is formed as a head of an action figure, rotational movement of the head in a first direction (e.g., left) to the first position alters a condition of the wireless network adapter 50 (e.g., from an off condition to an on condition via switch 51) and rotational movement of the head in a second direction (e.g., right) to the second position alters a condition of the Bluetooth adapter 52 (e.g., from an off condition to an on condition via switch 53). This can be accomplished by applying torque to the first actuator 14' about the lengthwise axis 11 in a clockwise or counterclockwise direction. Thus, movement of first actuator 14' between the first position, second position, and/or a position between the first position and second position alters the condition of wireless network adapter 50 and Bluetooth adapter 52. When first actuator 14' is in the first position, wireless network adapter 50 is in the on condition and Bluetooth adapter 52 is in the off condition. When first actuator 14' is in the second position, wireless network adapter 50 is in the off condition and Bluetooth adapter 52 is in the on condition. When first actuator 14' is in a position between the first position and the second position (e.g., head is facing forward), each of the wireless network adapter 50 and the Bluetooth adapter 52 is in the off condition. Alternative to each of the wireless network adapter 50 and Bluetooth adapter 52 being attached to first actuator 14', each of a wireless network adapter and a Bluetooth adapter can be attached to separate actuators of a plurality of actuators.

When wireless network adapter 50 is in the on condition, a first light source 19' of the plurality of light sources 19 disposed within a first opening defined by housing 12 emits light that has a first color. When Bluetooth adapter 52 is in the on condition, a second light source 19" of the plurality of light sources 19 disposed within a second opening defined by housing 12 emits light that has a second color. In this embodiment, the first color is different than the second color. Alternatively, the first color can be the same as the second color. Optionally, if a light source associated with a device switches between an on condition and an off condition (e.g., flashes) to indicate the condition of an associated device, the frequency of the switching (e.g., flashing) can be altered based on the condition of the associated device.

In use, linear movement of the first actuator 14' of the plurality of actuators 14 along the lengthwise axis 11 alters the condition of the voice recorder 56. For example, if the first actuator 14' of the plurality of actuators 14 is formed as a head of an action figure, movement of the head such that it moves toward the housing 12, alters a condition of the voice recorder 56 (e.g., from an off condition to an on condition via switch 57). Thus, linear movement of first actuator 14' between the first position and the second position along the lengthwise axis 11 alters the condition of voice recorder 56. When first actuator 14' is in a first position along the lengthwise axis 11, the voice recorder 56 is in the off condition. When first actuator 14' is in the second position along the lengthwise axis 11, the voice recorder 56 is in the on condition. For example, first actuator 14' can be spring-loaded such that it is biased to the first position without the application of a linear force along the lengthwise axis 11. When voice recorder 56 is in the on condition, a third light source 19'" of the plurality of light sources 19 disposed within an opening defined by first actuator 14' emits light that has a third color. The third color is different than the first and second colors. Alternatively, two or more of the light sources can emit light that has the same color when illuminated. Optionally, the condition of the memory flash card 54 can be altered when the condition of the voice recorder 56 is altered. For example, when voice recorder 56 is in the on condition, memory flash card 54 can also be in the on condition.

Rotational movement of the second actuator 14" of the plurality of actuators 14 about a second axis 11' alters the condition of the memory flash card 54. The second axis 11' is different than the lengthwise axis 11 and extends through housing 12 orthogonally through lengthwise axis 11. For example, if the second actuator 14" is formed as a first arm of an action figure, rotational movement of the first arm in a first direction (e.g., up), from the first position to the second position, alters a condition of the memory flash card 54 (e.g., from an off condition to an on condition via switch 55). In addition, rotational movement of the second actuator 14" of the plurality of actuators 14 from the second position to the first position alters a condition of the memory flash card 54 (e.g., from an on condition to an off condition via switch 55). This can be accomplished by applying torque to the second actuator 14" in the clockwise or counterclockwise direction about the second axis 11'. When second actuator 14" is in the first position, memory flash card 54 is in the off condition. When second actuator 14" is in the second position, memory flash card 54 is in the on condition. Alternatively, a condition of memory flash card 54 can be altered by attaching electronic device 10 to another device (e.g., computing device).

When memory flash card 54 is in the on condition (e.g., transferring data), a fourth light source 19"" of the plurality of light sources 19 emits light. When memory flash card 54 is in the on condition, the fourth light source 19"" emits light that has a fourth color that is different than the first, second, and third colors. The third light source 19'" is disposed within a first opening defined by the first actuator 14' (e.g., head) and the fourth light source 19"" is disposed within a second opening defined by the first actuator 14' (e.g., head). Thus, at least two light sources can be included in a character-based electronic device that represent the eyes of an action figure and can provide an indication as to the condition of memory flash card 54, voice recorder 56, and/or any other device or component included in a character-based electronic device.

Optionally, a character-based electronic device can provide automatic playback of data (e.g., media, music file, movie file) when an actuator attached to a data storage device (e.g., memory flash drive) is moved from a first position to a second position. For example, an actuator attached to a data storage device (e.g., memory flash drive) can be moved from the first position to the second position such that the condition of the data storage device has been altered to an on condition (e.g., active) and a media file (e.g., music file) can be initiated and played through a speaker. Alternatively, a character-based electronic device can provide automatic playback of data (e.g., media, music file, movie file) when the character-based electronic device is attached to a computing device (e.g., mobile device, cellular phone, computer, computing system, laptop, tablet, network). For example, when a character-based electronic device is attached to a computing device the condition of a data storage device can been altered to an on condition and a media file (e.g., music file) can be initiated and played through a speaker of the character-based electronic device, or through the computing device.

Automatic playback of data (e.g., media, music file, movie file) can be accomplished using any suitable method of initiating the communication of data and/or the playback of data through a component (e.g., speaker, display). Skilled artisans will be able to select a suitable method of initiating the communication of data and/or the playback of data through a component based on various considerations, including the type of data and the desired form of presentation to a user. An example method considered suitable to accomplish the presentation of data to a user includes incorporating an autostart file into the data such that the data is presented (e.g., triggered) once an event has been detected (e.g., power has been activated, actuator has been moved as described herein).

While particular actuators have been illustrated as associated with particular components, any suitable actuator, positioned on any suitable part, or portion, of a character-based electronic device can be associated with any suitable component. Skilled artisans will be able to select a suitable actuator to associate with a component, and a suitable position for the actuator, according to a particular embodiment based on various considerations, including the type of component intended to be used. As described herein, an actuator can comprise a manual actuator, electrical actuator, structures that form a button, spring-loaded button, knob, touch screen sensor, head, arm, leg, waist, tail, weapon, hair, shoe, clothing, and any other structure considered suitable for a particular embodiment.

While particular components have been described as associated with particular light sources disposed through an opening defined by an actuator and/or housing, any suitable component can be associated with a light source disposed within an opening defined by any suitable actuator or housing. Skilled artisans will be able to select a suitable component to associate with a light source, and a suitable opening to position the light source, according to a particular embodiment based on various considerations, including the type of component associated with the light source, and the structural arrangement of the character-based electronic device. For example, any component can be associated with a light source disposed within an opening defined by an actuator (e.g., appendage, head, arm, leg, waist, tail, weapon, hair, shoe, clothing), housing, or any other element of a character-based electronic device. For example, a light source can be disposed adjacent, or within, a housing and/or actuator to illuminate the housing and/or actuator when the light source is in the on condition. Optionally, based on the color of the housing and/or actuator, the color of the light emitted from a light source disposed adjacent, or within, a housing and/or actuator may be altered.

Optionally, the condition of two or more components can be altered such that a first component is in an on condition (e.g., active) and a second component is in an on condition (e.g., active) while the first component is in the on condition. This can be accomplished by moving an actuator, or two or more actuators, from a first position to a second position, a second position to a first position, or to a position between the first position and the second position. For example, the condition of a flash card can be altered such that it is in the on condition and the condition of a wireless network adaptor can be altered such that it is in the on condition while the flash card is in the on condition or the condition of a Bluetooth adapter can be altered such that it is in the on condition and the condition of a wireless network adaptor can be altered such that it is in the on condition while the Bluetooth adapter is in the on condition.

Alternatively, the condition of a first component can be dependent on the condition of a second component. For example, the condition of a first component can be altered such that a first component is in the on condition (e.g., active) and a second device can have a condition that is the opposite of the first component (e.g., is in the off condition). This can be accomplished by moving an actuator from a first position to a second position, a second position to a first position, or to a position between the first position and the second position.

Figure 3:
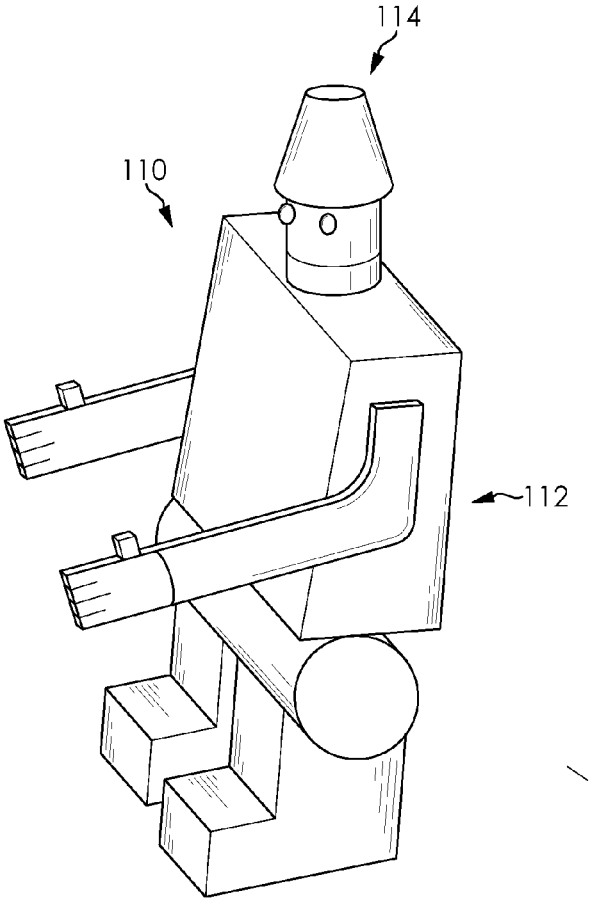
FIG. 3 is a perspective view of another character-based electronic device.

FIG. 3 illustrates another character-based electronic device 110. Electronic device 110 is similar to character-based electronic device 10 illustrated in FIGS. 1 and 2 and described above, except as detailed below. Reference numbers in FIG. 3 refer to the same structural element or feature referenced by the same number in FIGS. 1 and 2, offset by 100. In the illustrated embodiment, character-based electronic device 110 omits the inclusion of a plurality of actuators, and includes a single actuator 114 that functions as described above with respect to first actuator 14'. Character-based electronic device 110 has a structural arrangement that forms a character.

In the illustrated embodiment, the condition of memory flash card is dependent on the condition of the communication bus (e.g., USB hub), wireless network adapter, Bluetooth adapter, and voice recorder. When USB hub is not attached to another device (e.g., computing device) using upstream port, memory flash card is in the off condition. When USB hub is attached to another device (e.g., computing device) using upstream port, memory flash card is in the on condition. When each of the wireless network adapter, Bluetooth adapter, and voice recorder is in the off condition, memory flash card is in the off condition. When one of the wireless network adapter, Bluetooth adapter, or voice recorder is in the on condition, memory flash card is in the on condition.

Figure 4:
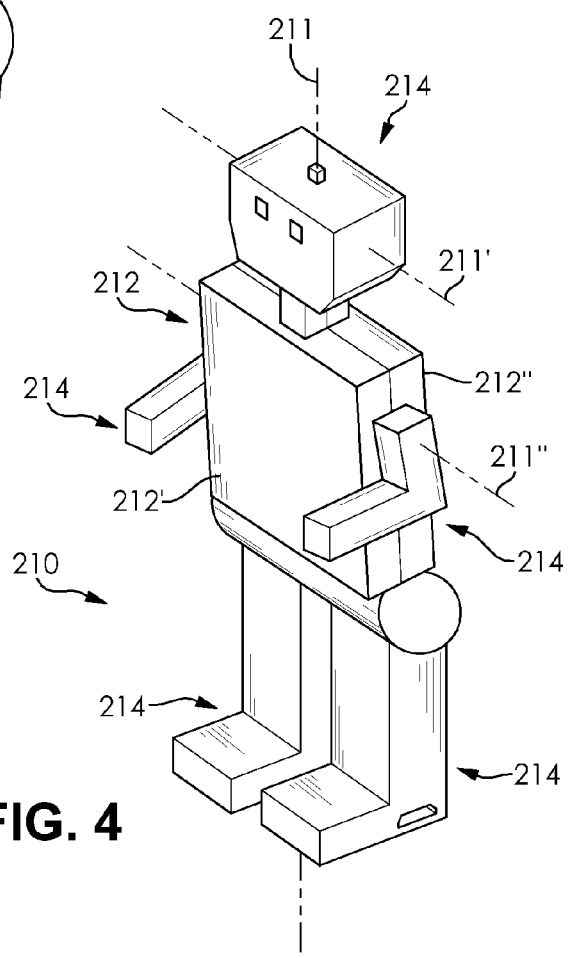
FIG. 4 is a perspective view of another character-based electronic device.
Figure 5:
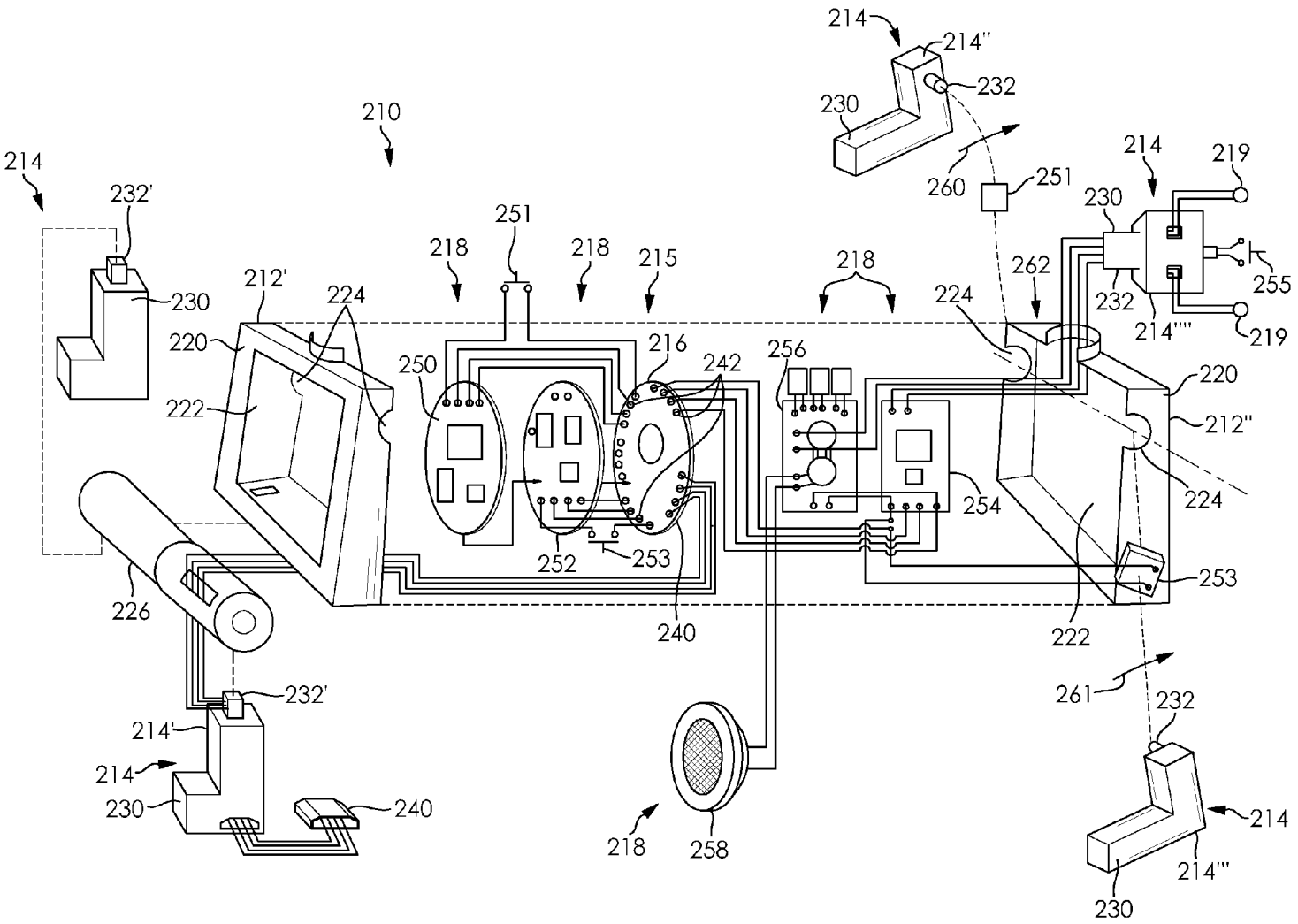
FIG. 5 is an exploded schematic view of the character-based electronic device illustrated in FIG. 4.

FIGS. 4 and 5 illustrate another character-based electronic device 210. Character-based electronic device 210 is similar to character-based electronic device 10 illustrated in FIGS. 1 and 2 and described above, except as detailed below. Reference numbers in FIGS. 4 and 5 refer to the same structural element or feature referenced by the same number in FIGS. 1 and 2, offset by 200. Thus, character-based electronic device 210 comprises housing 212, a plurality of actuators 214, a communication bus 215 (e.g., USB hub 216), a plurality of components 218, and a plurality of light sources 219. Character-based electronic device 210 has a structural arrangement that forms a character. In FIG. 5, an opening on the front of the housing 212 has been illustrated for clarity.

In the illustrated embodiment, housing 212 comprises a housing first portion 212', a housing second portion 212", a housing wall 220 that defines a housing cavity 222, a plurality of housing openings 224, and a housing shaft 226. Housing 212 is formed as a first portion of a character. Housing cavity 222 and housing openings 224 are cooperatively defined by housing first portion 212' and housing second portion 212". Housing cavity 222 is sized and configured to house USB hub 216 and each component of the plurality of components 218. Each opening of the plurality of housing openings 224 extends through the housing wall 220 and provides access to housing cavity 222. Housing shaft 226 is attached to an exterior surface of housing 212 and is configured such that one or more actuators (e.g., an actuator that defines a part of a character, an actuator that defines a portion of a character, appendage, body part, head, arm, leg, midsection, waist, thorax, tail, accessory of a character, weapon, hair, shoe, clothing) can be attached to the housing shaft 226.

In the illustrated embodiment, each actuator of the plurality of actuators 214 is moveably attached to housing 212 and comprises an actuator body 230. A first set of actuators of the plurality of actuators 214 defines a protuberance 232 that is sized and configured to be disposed within an opening of the plurality of openings 224 and a second set of the plurality of actuators 214 defines a protuberance 232' that is sized and configured to be attached to housing shaft 226. Each actuator of the plurality of actuators 214 is formed as another portion of the character that is different than the first portion formed by the housing 212. Each actuator of the plurality of actuators 214 is moveable relative to housing 212 between a first position, second position, and/or a position between the first position and the second position.

In the illustrated embodiment, USB hub 216 is disposed entirely within cavity 222 defined by housing 212 and comprises a bus-powered hub. USB hub 216 comprises an upstream port 240 and a plurality of downstream ports 242. Upstream port 240 is disposed within an opening defined by the wall of a first actuator 214' of the plurality of actuators 214 that is rotatably attached to housing shaft 226.

In the illustrated embodiment, each component of the plurality of components 218 is disposed entirely within housing cavity 222 and is attached to USB hub 216 using a downstream port of the plurality of downstream ports 242. Thus, each component of the plurality of components 218 is attached to USB hub 216.

A first component of the plurality of components 218 is a wireless network adapter 250. A second component of the plurality of components 218 is a Bluetooth adapter 252. A third component of the plurality of components 218 is a memory flash card 254. A fourth component of the plurality of components 218 is a voice recorder 256 that is attached to memory flash card 254 and comprises a speaker 258 that produces sound waves and a microphone that obtains sound waves.

A first switch 251 is disposed between wireless network adapter 250 and USB hub 216 and is adapted to change a condition of wireless network adapter 250 (e.g., on, off). A second switch 253 is disposed between Bluetooth adapter 252 and USB hub 216 and is adapted to change a condition of Bluetooth adapter 252 (e.g., on, off). A third switch 255 is disposed between voice recorder 256 and memory flash card 254 and is adapted to change a condition of voice recorder 256 and memory flash card 254 (e.g., on, off).

In the illustrated embodiment, the first switch 251 is attached to a second actuator 214" of the plurality of actuators 214, the second switch 253 is attached to a third actuator 214''' of the plurality of actuators 214, and the third switch 255 is attached to a fourth actuator 214'''' of the plurality of actuators 214. Each component of the plurality of components 218 has at least a first condition and a second condition. Each condition of a component of the plurality of components 218 is based on a position of its associated switch, which is based on the position of its associated actuator of the plurality of actuators 214. Therefore, movement of an actuator between a first position, a second position, and/or a position between the first position and the second position, alters the condition of an associated component.

Each light source of the plurality of light sources 219 is disposed within an opening defined by the fourth actuator 214'''' and is attached to USB hub 216 and voice recorder 256. Each light source of the plurality of light sources 219 is adapted to indicate a condition of the USB hub 216 and voice recorder 256 by providing constant illumination when the USB hub 216 is attached to another device via upstream port 240 or when voice recorder 256 is in an on condition. Each light source of the plurality of light sources 219 comprises a light emitting diode (LED) and is disposed on a first axis 211' that extends orthogonal to the lengthwise axis 211 of character-based electronic device 210.

In the illustrated embodiment, the first actuator 214' of the plurality of actuators 214 is formed as a leg of character-based electronic device 210, each of the second actuator 214" and third actuator 214''' is formed as an arm of character-based electronic device 210, and fourth actuator 214'''' is formed as a head of character-based electronic device 210 and is spring-loaded such that it is biased to the first position.

In use, rotational movement of the second actuator 214" of the plurality of actuators 214, in the direction indicated by arrow 260, or an opposite direction, about a second axis 211" alters the condition of the wireless network adapter 250 via switch 251. The second axis 211" extends through housing 212 and is disposed orthogonal to lengthwise axis 211. This can be accomplished by applying torque to the second actuator 214" in either a clockwise or counterclockwise direction about the second axis 211". In use, rotational movement of the third actuator 214''' of the plurality of actuators 214, in the direction indicated by arrow 261, or an opposite direction, about the second axis 219" alters the condition of the Bluetooth adapter 252 via switch 253. This can be accomplished by applying torque to the third actuator 214''' in either a clockwise direction or counterclockwise direction about the second axis 211". In use, linear movement of the fourth actuator 214'''' of the plurality of actuators 214, in the direction indicated by arrow 262, or an opposite direction, along the lengthwise axis 211 alters the condition of the voice recorder 256. This can be accomplished by applying a force along the lengthwise axis 211 in a direction toward the housing 212.

In use, rotational movement of the second actuator 214" in the direction of arrow 260 from the first position to the second position alters the condition of the wireless network adapter 250 from an off condition to an on condition. Rotational movement of the second actuator 214" in a direction opposite of arrow 260 from the second position to the first position alters the condition of the wireless network adapter 250 from an on condition to an off condition. Thus, wireless network adapter 250 is in the on condition when second actuator 214" is in the second position and is in the off condition when second actuator 214" is in the first position.

In use, rotational movement of the third actuator 214''' in the direction of arrow 261 from the first position to the second position alters the condition of the Bluetooth adapter 252 from an off condition to an on condition. Rotational movement of the third actuator 214''' in a direction opposite of arrow 261 from the second position to the first position alters the condition of the Bluetooth adapter 252 from an on condition to an off condition. Bluetooth adapter 252 is in the on condition when third actuator 214''' is in the second position and is in the off condition when third actuator 214''' is in the first position. Wireless network adapter 250 can be in the on condition when Bluetooth adapter 252 is in the on condition.

When Bluetooth adapter 252 is in the on condition, it is adapted to transfer and receive data from devices, components, or systems that are synched with Bluetooth adapter 252. For example, if synched with a mobile phone, character-based electronic device can receive data associated with a music file and play the music through speaker 258. In addition, if synched with a mobile phone, character-based electronic device can receive data associated with a phone call such that the speaker 258 and microphone can be used to complete the phone call.

In use, linear movement of the fourth actuator 214"" in the direction of arrow 262 from the first position to the second position alters the condition of the voice recorder 256 and memory flash drive 254 from an off condition to an on condition. Linear movement of the fourth actuator 214"" in a direction opposite of arrow 262 from the second position to the first position alters the condition of the voice recorder 256 and memory flash drive 254 from an on condition to an off condition. When voice recorder 256 is in the on condition, each light source of the plurality of light sources 219 provides illumination and emits a light that has a blue color.

When character-based electronic device 210 is attached to another device via upstream port 240, memory flash drive 254 provides automatic playback of data (e.g., media, music file, movie file) stored on memory flash drive 254, as described herein. For example, data that has been prerecorded using voice recorder 256 can be automatically played through speaker 258 using, for example, an autostart file, as described herein. This can be accomplished, for example, when a character-based electronic device 210 is attached to a computing device and the condition of the memory flash drive 254 is altered from an off condition to an on condition such that a media file (e.g., music file) stored on the memory flash drive is initiated and played through speaker 258. Alternatively, the automatic playback of data can be activated upon movement of an actuator from a first position to a second position, or vice versa. Alternatively, a character-based electronic device can omit the inclusion of an automatic playback functionality.

When character-based electronic device 210 is attached to another device via upstream port 240 (e.g., computing device), data stored on memory flash drive 254 can be accessed using conventional methods of accessing data on a data storage device. For example, data stored on memory flash drive 254 can be accessed by locating the drive associated with memory flash card 254 using a user interface of a computing device. Alternatively, the data stored on a character-based electronic device can be accessed through a network when the character-based electronic device is connected to the network.

Figure 6:
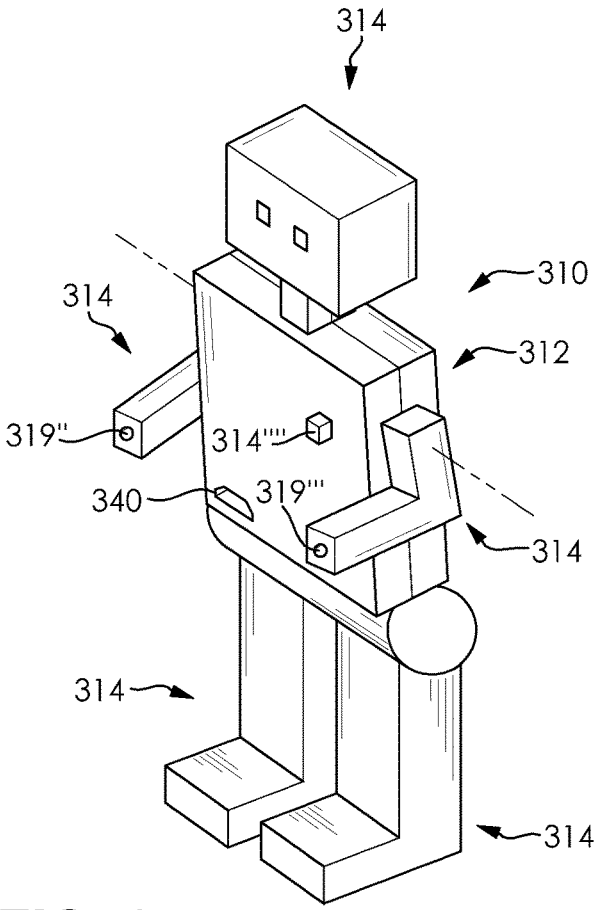
FIG. 6 is a perspective view of another character-based electronic device.
Figure 7:
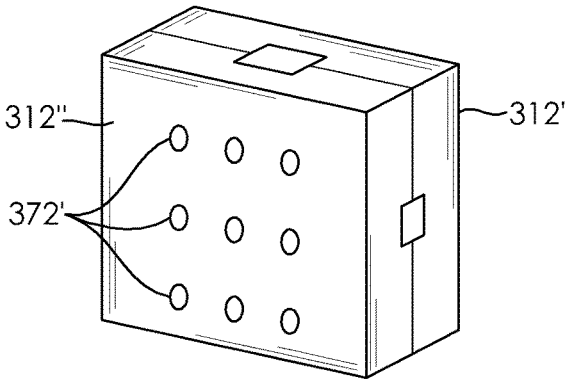
FIG. 7 is a perspective view of the housing of the character-based electronic device illustrated in FIG. 6.
Figure 8:
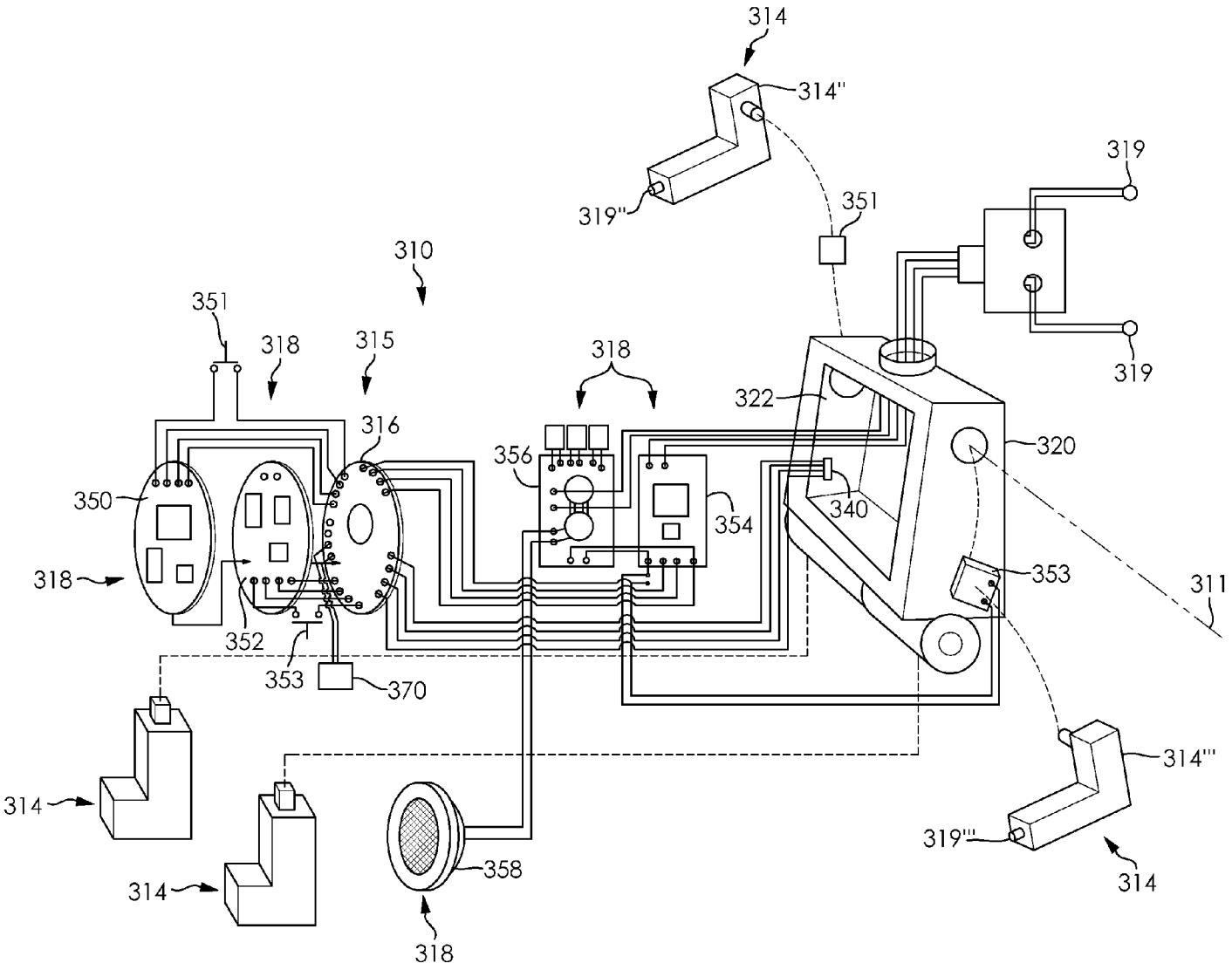
FIG. 8 is an exploded schematic view of the character-based electronic device illustrated in FIG. 6.

FIGS. 6, 7, and 8 illustrate another character-based electronic device 310. Character-based electronic device 310 is similar to electronic device 210 illustrated in FIGS. 4 and 5 and described above, except as detailed below. Reference numbers in FIGS. 6, 7, and 8 refer to the same structural element or feature referenced by the same number in FIGS. 4 and 5, offset by 100. Thus, character-based electronic device 310 comprises housing 312, a plurality of actuators 314, a communication bus 315 (e.g., USB hub 316), a plurality of devices 318, and a plurality of light sources 319. Character-based electronic device 310 has a structural arrangement that forms a character. In FIG. 8, an opening on the front of the housing 312 has been illustrated for clarity.

In the embodiment illustrated, USB hub 316 comprises a self-powered hub and character-based electronic device 310 includes energy storage device 370 attached to USB hub 316. A first set of light sources 319' of the plurality of lights sources 319 is attached to the energy storage device 370 such that when the energy storage device has a first level of energy each light source of the first set of light sources 319' emits a light that has a first color (e.g., blue). When the energy storage device 370 has a second level of energy that is lower than the first level, each light source of the first set of light sources 319' emits a light that has a second color (e.g., red). This first color is different than the second color light. In addition, housing second portion 312" defines a plurality of openings 372 that are sized and configured to allow sound waves to be emitted from speaker 358 disposed within housing cavity 322 to an environment exterior to housing cavity 322 and allow sound waves to be transferred to the microphone associated with voice recorder 356 disposed within housing cavity 322 from an environment exterior to the housing cavity 322.

In the illustrated embodiment, the upstream port 340 is disposed within an opening defined by housing wall 320 and the fourth actuator 314"" comprises a spring-loaded button disposed within an opening defined by housing wall 320. In addition, character-based electronic device 320 comprises a second light source 319" disposed within an opening defined on second actuator 314" and a third light source 319''' disposed within an opening defined on third actuator 314'''. Second light source 319" is attached to the wireless network adapter 350 and is adapted to illuminate when the wireless network adapter 350 is in the on condition. Third light source 319''' is attached to the Bluetooth adapter 352 and is adapted to illuminate when the Bluetooth adapter 352 is in the on condition. Each of the second light source 319" and third light source 319''' illuminate a solid color light. Alternatively, second light source 319" and third light source 319''' can switch between an on condition and an off condition (e.g., flash). When second light source 319" and/or third light source 319''' switches between an on condition and an off condition, the frequency of the switching can be based on the condition of the associated component (e.g., the strength of the network, the range of the network, a connection between the character-based electronic device and another device (e.g., computing device, another character-based electronic device, component)).

Alternatively, each of a second light source and third light source can be disposed on an exterior surface of its relative actuator and extend away from the body of the actuator. Optionally, a transparent or translucent material that is attached to an actuator can be disposed over a light source (e.g., third light source, fourth light source) and extend any suitable distance from the actuator to form a light path for the light being emitted from the light source.

Any of the elements, features, and/or structural arrangements described herein with respect to any character-based electronic device can be combined in any suitable manner. Skilled artisans will be able to select a suitable element, feature, and/or structural arrangement to include in a character-based electronic device according to a particular embodiment based on various considerations, such as the desired functionality of a character-based electronic device.

Figure 9:
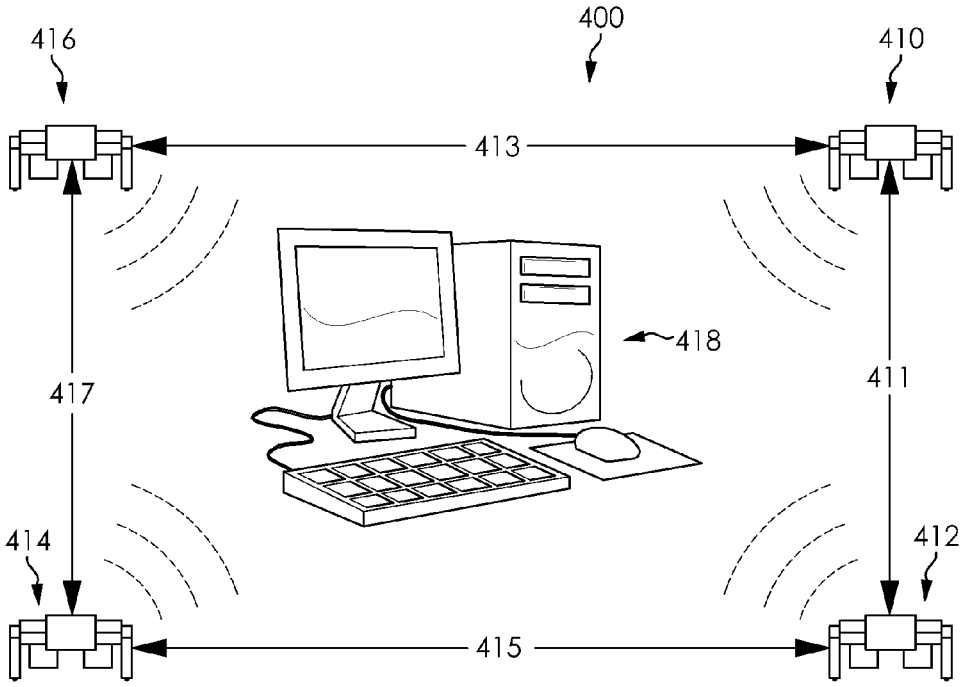
FIG. 9 is a schematic view of a character-based electronic system.

FIG. 9 illustrates a character-based electronic system 400. System 400 comprises a first character-based electronic device 410, a second character-based electronic device 412, a third character-based electronic device 414, a fourth character-based electronic device 416, and a computing system 418. Alternative to a computing system 418, a system can include any suitable device, such as a mobile device, cellular phone, computer, laptop, tablet, and any other device considered suitable for a particular embodiment.

Each of the first character-based electronic device 410, second character-based electronic device 412, third character-based electronic device 414, and fourth character-based electronic device 416 can comprise any suitable character-based electronic device according to embodiment, such as the embodiments described and illustrated herein. Skilled artisans will be able to select a suitable character-based electronic device to use in a system according to a particular embodiment based on various considerations, including the desired functionality of the system. Example character-based electronic devices considered suitable to use in system 400 include character-based electronic device 10, character-based electronic device 110, character-based electronic device 210, character-based electronic device 310, and any other character-based electronic device considered suitable for a particular application.

In the illustrated embodiment, each of the first character-based electronic device 410, second character-based electronic device 412, third character-based electronic device 414, and fourth character-based electronic device 416 comprise a character-based electronic device as described with respect to FIGS. 6, 7, and 8. Alternatively, a first character-based electronic device can be different from a second character-based electronic device, a third character-based electronic device, and/or a fourth character-based electronic device, or at least two of the character-based electronic devices can be different from one another.

While system 400 has been illustrated as including a first character-based electronic device 410, a second character-based electronic device 412, a third character-based electronic device 414, and a fourth character-based electronic device 416, a system can include any suitable number of character-based electronic devices. Example number of character-based electronic devices considered suitable to include in a system include one, at least one, two, a plurality, three, four, five, six, seven, eight, and any other number considered suitable for a particular application.

Computing system 418 can comprise any suitable general purpose or special purpose computer adapted to be attached to, included with, or synched with, a character-based electronic device or to communicate with an character-based electronic device (e.g., over a network, wirelessly). For example, computing system 418 may be any one of a personal computer system, a work station computer system, a laptop computer system, an embedded controller system, a microprocessor-based system, a digital signal processor-based system, a hand held device system, a personal digital assistant (PDA) system, a wireless system, a wireless networking system, mobile device, mobile telephone, smart phone, electronic device, such as those described herein, or any other device considered suitable for a particular application. The computing system 418 can include a bus or other communication mechanism for communicating information and a processor coupled with bus for processing the information. The computing system 418 can also include a main memory, such as a random access memory (RAM) or other dynamic storage device (e.g., dynamic RAM (DRAM), static RAM (SRAM), synchronous DRAM (SDRAM), flash RAM)), coupled to the bus for storing information and instructions to be executed by the processor. In addition, the main memory may be used for storing temporary variables or other intermediate information during execution of instructions to be executed by the processor. Computing system 418 can further include a read only memory (ROM) or other static storage device (e.g., programmable ROM (PROM), erasable PROM (EPROM), and electrically erasable PROM (EEPROM)) coupled to the bus for storing static information and instructions for the processor. A storage device, such as a magnetic disk or optical disk, can be provided and coupled to the bus for storing information and instructions, such as instructions for completing one or more of the methods, elements, steps, optional steps, alternative steps, and/or components described herein.

The computing system 418 may also include input/output ports to couple the computing system 418 to external devices. Such coupling may include direct electrical connections, wireless connections, networked connections, etc., for implementing automatic control functions, remote control functions, etc.

The computing system 418 may also include special purpose logic devices (e.g., application specific integrated circuits (ASICs)) or configurable logic devices (e.g., generic array of logic (GAL) or re-programmable field programmable gate arrays (FPGAs)). Other removable media devices (e.g., a compact disc, a tape, and a removable magneto-optical media) or fixed, high-density media drives may be added to the computing system 418 using an appropriate device bus (e.g., a small computer system interface (SCSI) bus, an enhanced integrated device electronics (IDE) bus, or an ultra-direct memory access (DMA) bus). The computing system 418 may additionally include a compact disc reader, a compact disc reader-writer unit, or a compact disc jukebox, each of which may be connected to the same device bus or another device bus.

The computing system 418 may be coupled via the bus to a display, such as a cathode ray tube (CRT), liquid crystal display (LCD), Light-emitting Diode (LED) display, plasma display, voice synthesis hardware and/or software, etc., for displaying and/or providing information to a computer user (e.g., one or more of the methods, elements, steps, optional steps, alternative steps, and/or components described herein). The display may be controlled by a display or graphics card. The computing system 418 can include input devices, such as a keyboard and a cursor control, for communicating information and command selections to the processor. Such command selections can be implemented via voice recognition hardware and/or software functioning as the input devices. The cursor control, for example, can be a mouse, a trackball, cursor direction keys, touch screen display, optical character recognition hardware and/or software, voice recognition hardware and/or software, etc., for communicating direction information and command selections to the processor and for controlling cursor movement on the display. In addition, a printer may provide printed listings of the data structures, information, etc., or any other data stored and/or generated by the computing system 418.

The computing system 418 can perform a portion, or the entirety, of the processing steps, methods, elements, steps, optional steps, alternative steps, and/or components as described herein in response to the processor executing one or more sequences of one or more instructions contained in a memory, such as the main memory. Such instructions may be read into the main memory from another computer readable medium, such as a storage device, another computer, or otherwise. One or more processors in a multi-processing arrangement may also be employed to execute the sequences of instructions contained in the main memory. In alternative embodiments, hard-wired circuitry may be used in place of or in combination with software instructions. Thus, embodiments are not limited to any specific combination of hardware circuitry and software.

As stated above, the computing system 418 includes at least one computer readable medium or memory programmed according to one or more of the methods, elements, steps, optional steps, alternative steps, and/or components described herein and/or for containing data structures, tables, records, or other data described herein. Examples of computer readable media are compact discs, hard disks, floppy disks, tape, magneto-optical disks, PROMs (EPROM, EEPROM, Flash EPROM), DRAM, SRAM, SDRAM, etc. Stored on any one or on a combination of computer readable media, the one or more methods, elements, steps, optional steps, alternative steps, and/or components described herein can include software for controlling the computer system, for driving a device or devices (e.g., one or more processors) for implementing the one or more methods, elements, steps, optional steps, alternative steps, and/or components described herein, and/or for enabling the computer system to interact with a human user. Such software may include, but is not limited to, device drivers, operating systems, development tools, and applications software. Such computer readable media further includes the computer program product of the one or more methods, elements, steps, optional steps, alternative steps, and/or components described herein for performing a portion (e.g., if processing is distributed), or the entirety, of the processing performed in implementing the one or more methods, elements, steps, optional steps, alternative steps, and/or components described herein.

Any method, element, step, optional step, alternative step, logic, and/or application described herein can comprise software or code that can be embodied in a non-transitory computer-readable medium, or one or more non-transitory computer-readable storage media, for use by or in connection with an instruction execution system such as, for example, a processor in a computing system (e.g., computing system 418) or other system. In this sense, the method, element, step, optional step, alternative step, logic, or application, may comprise, for example, statement including instructions and declarations that can be fetched from the computer-readable medium and executed by the instruction execution system.

The term "computer readable medium" as used herein refers to any medium that can provide instructions to a processor for execution. A computer readable medium may take many forms, including but not limited to, non-volatile media, volatile media, and transmission media. Non-volatile media includes, for example, optical, magnetic disks, and magneto-optical disks, such as the storage device. Volatile media includes dynamic memory, such as the main memory. Transmission media includes coaxial cables, copper wire and fiber optics, including the wires that comprise the bus. Transmission media also may also take the form of acoustic or light waves, such as those generated during radio wave and infrared data communications.

Common forms of computer readable media include, for example, non-transitory media, non-transitory computer-readable storage media, hard disks, floppy disks, tape, magneto-optical disks, PROMs (EPROM, EEPROM, Flash EPROM), DRAM, SRAM, SDRAM, or any other magnetic medium, compact disks (e.g., CD-ROM), or any other optical medium, punch cards, paper tape, or other physical medium with patterns of holes, a carrier wave (described below), or any other medium from which a computer can read.

Various forms of computer readable media may be involved in carrying out, or containing, one or more sequences of one or more instructions to a processor for execution. For example, the one or more methods, elements, steps, optional steps, alternative steps, and/or components described herein can be described in the general context of computer executable instructions, such as program modules, or program components, being executed by a computer. Program modules or components include routines, objects, data structures, tasks, etc. that can perform particular tasks or implement particular abstract data types. For example, the instructions may initially be carried on a magnetic disk of a remote computer. The remote computer can load the instructions for implementing a portion, or the entirety, of the one or more methods, elements, steps, optional steps, alternative steps, screen renderings, and/or components described herein, remotely into a dynamic memory and send the instructions over a telephone line using a modem. Alternatively, in another example, the instructions can be sent over a network connection using a modem, a network interface card, a wireless connection, or any other suitable form of network connection. A modem local to computing system 418 may receive the data on the telephone line and use an infrared transmitter to convert the data to an infrared signal. An infrared detector coupled to the bus can receive the data carried in the infrared signal and place the data on the bus. The bus carries the data to main memory, from which the processor retrieves and executes the instructions. The instructions received by the main memory may optionally be stored on the storage device either before or after execution by the processor. In a distributed computing environment, program modules or components can be located in both local and/or remote computer storage media including memory storage devices.

The computing system 418 can also include a communication interface coupled to the bus. The communication interface provides a two-way data communication coupling to a network link that may be connected to, for example, a local network. For example, the communication interface may be a network interface card to attach to any packet switched local area network (LAN). As another example, the communication interface may be an asymmetrical digital subscriber line (ADSL) card, an integrated services digital network (ISDN) card or a modem to provide a data communication connection to a corresponding type of telephone line. Wireless links may also be implemented via the communication interface. In any such implementation, the communication interface sends and receives electrical, electromagnetic, or optical signals that carry digital data streams representing various types of information.

The network link typically provides data communication through one or more networks to other data devices. For example, the network link may provide a connection to a computer through local network (e.g., a LAN) or through equipment operated by a service provider, which provides communication services through a communications network. In some embodiments, the local network and the communications network use electrical, electromagnetic, or optical signals that carry digital data streams. The signals through the various networks and the signals on the network link and through the communication interface, which carry the digital data to and from computing system 418, are exemplary forms of carrier waves transporting the information. The computing system 418 can transmit notifications and receive data, including program code, through the network(s), network link and communication interface. Alternatively, near field communication (NFC) can be utilized to provide data communication between one or more devices and/or systems.

Any of the character-based electronic devices described herein can include any of the devices, systems, and/or components as described above with respect to computing system 418. Skilled artisans will be able to select a suitable device, system, and/or component to include in a character-based electronic device according to a particular embodiment based on various considerations, including the intended use of the character-based electronic device. Examples of character-based electronic devices considered suitable to include one or more of the devices, systems, or components described above with respect to computing system 418 include character-based electronic device 10, character-based electronic device 110, character-based electronic device 210, character-based electronic device 310, and any other character-based electronic device considered suitable for a particular embodiment.

First character-based electronic device 410 is positioned a first distance 411 from second character-based electronic device 412 and a second distance 413 from fourth character-based electronic device 416. Third character-based electronic device 414 is positioned a third distance 415 from second character-based electronic device 412 and a fourth distance 417 from fourth character-based electronic device 416. The first distance 411 is equal to the fourth distance 417 and the second distance 413 is equal to the third distance 415, but different than the first distance 411. However, other distances are considered suitable for each of the first distance, second distance, third distance, and fourth distance. Example distances considered suitable include each distance being equal to one another, each distance being different from one another, at least two distances being equal to one another, at least two distance being different from one another, and any other distance considered suitable for a particular application.

Each of the first character-based electronic device 410, second character-based electronic device 412, third character-based electronic device 414, and fourth character-based electronic device 416 has an actuator positioned such that the Bluetooth adapter is in the on condition. The first character-based electronic device 410 is synched with the computing device 418 such that one or more processes and/or data can be transferred between the first character-based electronic device 410 and the computing device 418. Each of the second character-based electronic device 412, third character-based electronic device 414, and fourth character-based electronic device 416 are synched with first character-based electronic device 410 such that one or more processes and/or data can be transferred between each of the character-based electronic devices 412, 414, and 416 and the first character-based electronic device 410. Alternatively, each of the second character-based electronic device, third character-based electronic device, and/or fourth character-based electronic device can also be synched with the computing device in combination with, or separate from, the first character-based electronic device. Alternatively, first character-based electronic device can be attached to computing device via a data communication cord that is attached at a first end to the upstream port of first character-based electronic device and at a second end to a USB port of the computing device.

In use, the first character-based electronic device 410 can receive data sent by computing device 418 and transmit the data, or a portion of the data, to one or more of the second character-based electronic device 412, third character-based electronic device 414, and/or fourth character-based electronic device 416. For example, data associated with a music file can be transmitted to first character-based electronic device 410 and can be subsequently transmitted to one or more of the second character-based electronic device 412, third character-based electronic device 414, and/or fourth character-based electronic device 416.

Optionally, a character-based electronic device or a computing device can transmit different portions of a data file to different character-based electronic devices included in a system. For example, when a data file (e.g., a music file) is transmitted, a first portion of the data file can be transmitted to a first character-based electronic device, a second portion of the data file can be transmitted to a second character-based electronic device, a third portion of the data file can be transmitted to a third character-based electronic device, and a fourth portion of the data file can be transmitted to a fourth character-based electronic device. Each of the first portion, second portion, third portion, and fourth portion of the data file are different portions of the data file. For example, the first portion can be data associated with the lead vocal portion of the data file, the second portion can be associated with the drum portion of the data file, the third portion can be associated with the guitar portion of the data file, and the fourth portion can be associated with the bass portion of the data file.

Optionally, a character-based electronic device can transmit data to other character-based electronic devices without the inclusion of a computing device. For example, a first character-based electronic device can be synched with a second character-based electronic device and a third character-based electronic device. An actuator on the first character-based electronic device can be moved from the first position to the second position to initiate the transfer of data from the first character-based electronic device to the second and third character-based electronic devices.

Optionally, a first character-based electronic device can transmit data and one or more character-based electronic devices can receive the data. The data can be stored or used by one or more of the components housed within the one or more character-based electronic devices. Optionally, a system can comprise a first character-based electronic device and a computing device (e.g., mobile device, cellular phone, computer, computing system, laptop, tablet, network). When the first character-based electronic device has an actuator in a position such that a network (e.g., Bluetooth, wireless) has been activated, it can be synched with the computing device such that it can share data with the computing device and obtain data from the computing device.

Various methods are described herein. While the methods described herein are shown and described as a series of acts, it is to be understood and appreciated that the methods are not limited by the order of acts, as some acts may in accordance with these methods, be omitted, be repeated, or occur in different orders and/or concurrently with other acts described herein.

Figure 10:
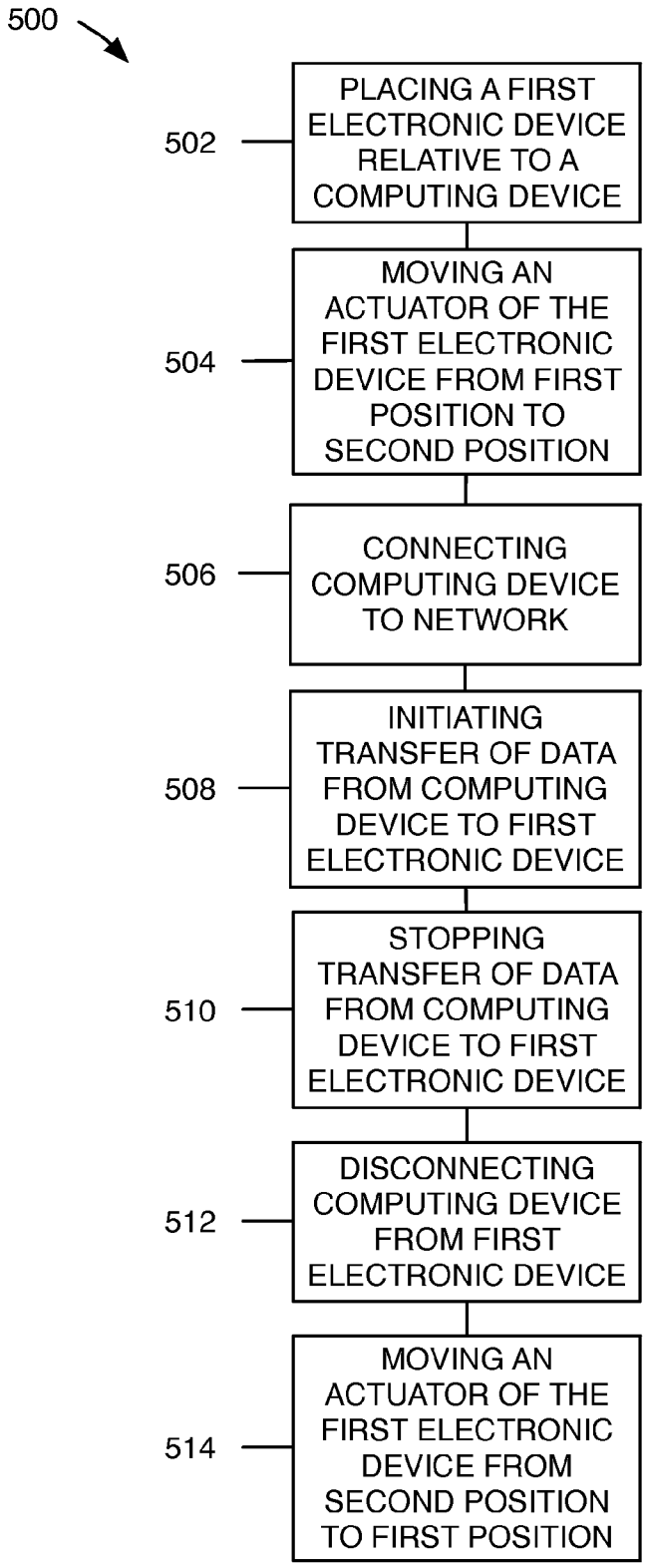
FIG. 10 is a flowchart representation of a method of using a character-based electronic system.

FIG. 10 is a flowchart representation of a method of using a character-based electronic system 500.

A step 502 comprises placing a first character-based electronic device relative to a computing device. Another step 504 comprises moving an actuator of the first character-based electronic device from a first position to a second position to activate a network on the first character-based electronic device. Another step 506 comprises connecting the computing device to the network activated by the first character-based electronic device. Another step 508 comprises initiating the transfer of data from the computing device to the first character-based electronic device. Another step 510 comprises stopping the transfer of data from the computing device to the first character-based electronic device. Another step 512 comprises disconnecting the computing device from the network of the first character-based electronic device. Another step 514 comprises moving the actuator of the first character-based electronic device from the second position to the first position to deactivate the network on the first character-based electronic device.

While method 500 has been described as being accomplished using a first character-based electronic device, any suitable number of character-based electronic devices can be included in method 500 and can be used as described herein.

Example number of character-based electronic devices considered suitable to include in method 500 include one, at least one, two, a plurality, three, four, five, and any other number considered suitable for a particular application.

Any suitable character-based electronic device according to embodiment can be used to complete method 500, such as the embodiments described and illustrated herein. Skilled artisans will be able to select a suitable character-based electronic device according to a particular embodiment based on various considerations, including the desired functionality of the character-based electronic device. Example character-based electronic devices considered suitable to use in method 500, or any other method described herein, include character-based electronic device 10, character-based electronic device 110, character-based electronic device 210, character-based electronic device 310, and any other character-based electronic device considered suitable for a particular application.

Step 502 can be accomplished by positioning the first character-based electronic device a first distance from the computing device. The first distance can be within any suitable range that allows communication between the first character-based electronic device and computing device.

Step 504 can be accomplished by applying force to the actuator of the first character-based electronic device such that the actuator moves from the first position to the second position and alters the condition of a device of the character-based electronic device (e.g., wireless network adapter, Bluetooth adapter) from the off condition to the on condition. Force can be applied in any suitable manner such that the actuator is moved from the first position to the second position. Example forces considered suitable include linear force, torque, and any other force considered suitable for a particular application.

Step 506 can be accomplished using any suitable method of connecting a computing device to the first character-based electronic device. For example, step 506 can be accomplished by locating the network provided by the first character-base electronic device through a user interface provided on a display of the computing device and connecting to the network.

Alternative to connecting the computing device to the first character-based electronic device through a network, the computing device can be connected to the first character-based electronic device using a data communication wire such that a direct connection between the computing device and the first character-based electronic device is accomplished.

Optionally, when more than one character-based electronic device is included in method 500, an optional step comprises connecting a second character-based electronic device to the network activated by the first character-based electronic device and/or the computing system such that data can be transferred between the first character-based electronic device, the second character-based electronic device, and/or the computing device. This can be accomplished, for example, by moving an actuator of the second character-based electronic device from the first position to the second position, as described herein, to alter the state of a device from the off condition to the on condition.

Step 508 can be accomplished using any suitable method of transferring data over a network to first character-based electronic device. For example, step 508 can be accomplished by opening an application on the computing device and initiating a data transfer from the computing device to the first character-based electronic device over the network, or vice versa. Alternatively, when first character-based electronic device is directly connected to computing device, a data communication wire can be used to transfer data from the computing device to the first character-based electronic device. Alternatively, step 508 can be automatically performed by the character-based electronic device or the computing device using, for example, an autostart file.

Another optional step that can be completed when more than one character-based electronic device is included in method 500 comprises initiating the transfer of data from the first character-based electronic device and/or computing system to the second character-based electronic device. This can be accomplished, for example, by moving an actuator of the second character-based electronic device from the first position to the second position, as described herein, to alter the state of a device from the off condition to the on condition.

Step 510 can be accomplished using any suitable method of stopping the transfer of data over a network to first character-based electronic device. For example, step 510 can be accomplished by opening an application on the computing device and stopping the transfer of data from the computing device to the first character-based electronic device over the network, or vice versa. Alternatively, when first character-based electronic device is directly connected to computing device, an optional step comprises detaching the data communication wire from the computing device and/or the first character-based electronic device to stop the transfer of data.

Another optional step that can be completed when more than one character-based electronic device is included in method 500 comprises stopping the transfer of data from the first character-based electronic device and/or computing system to the second character-based electronic device. This can be accomplished, for example, by moving an actuator from the second position to the first position as described herein to alter the state of a device from the on condition to the off condition.

Step 512 can be accomplished using any suitable method of disconnecting a computing device from the first character-based electronic device. For example, step 512 can be accomplished through a user interface provided on the computing device by locating the network provided by first character-based electronic device and disconnecting from the network. Alternatively, when first character-based electronic device is directly connected to computing device an optional step comprises detaching the communication wire from the computing device and/or the first character-based electronic device to stop the transfer of data.

Step 514 can be accomplished by applying force to the actuator of the first character-based electronic device such that the actuator moves from the second position to the first position and alters the condition of a device of the first character-based electronic device from the on condition to the off condition. Force can be applied in any suitable manner such that the actuator is moved from the second position to the first position. Example forces considered suitable include linear force, torque, and any other force considered suitable for a particular application.

Figure 11:
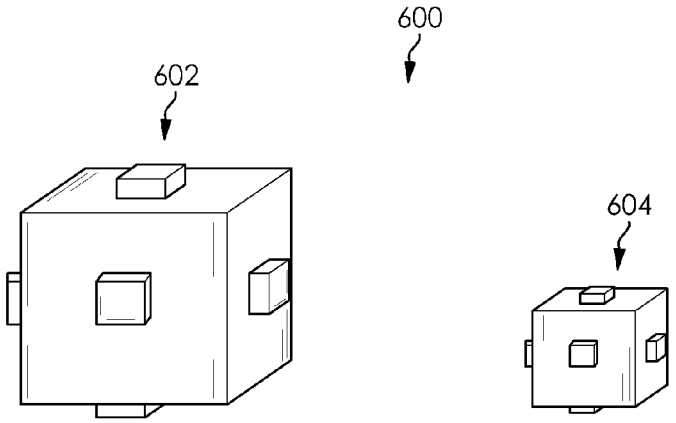
FIG. 11 is a perspective view of a promotional system having a character-based electronic device.

FIG. 11 is a perspective view of a promotional system 600 that comprises a product 602 and a character-based electronic device 604 that is a substantially similar scaled representation of the product 602. Thus, the character-based electronic device 604 is based on the product 602.

In the illustrated embodiment, character-based electronic device 604 has an external structural arrangement that is substantially similar to the external structural arrangement of product 602 and is scaled relative to product 602. The character-based electronic device 604 is substantially similar to the product 602 such that a casual observer would recognize the character-based electronic device as a scaled representation of the product 602. It is understood that some structural details are changed and/or omitted during any scaling process. In addition, it is understood that some structural details may be modified to achieve an actuator, such as those described herein, to impart functionality on the character-based electronic device based on a structural feature of the product.

Skilled artisans will be able to select a suitable amount to scale a character-based electronic device relative to a product based on various considerations, including the intended purpose of the character-based electronic device. For example, a character-based electronic device can be scaled such that it is 1:1, 1:2, 1:3, 1:4, 1:5, 1:10, 1:20, between about 1:1 and about 1:20, and any other proportional ratio considered suitable for a particular application. Alternative to a character-based electronic device having an external structural arrangement that is substantially similar to a product, a character-based electronic device can have an external structural arrangement that is identical, substantially identical, or substantially similar to a product.

In the illustrated embodiment, character-based electronic device 604 can include any of the elements, features, and/or structural arrangements described above with respect to character-based electronic device 10, character-based electronic device 110, character-based electronic device 210, character-based electronic device 310, and any other element, feature, and/or structural arrangement considered suitable for a particular embodiment. For example, any element, feature, and/or structural arrangement of a product can be altered such that it functions as a housing and/or an actuator as described herein.

Figure 12:
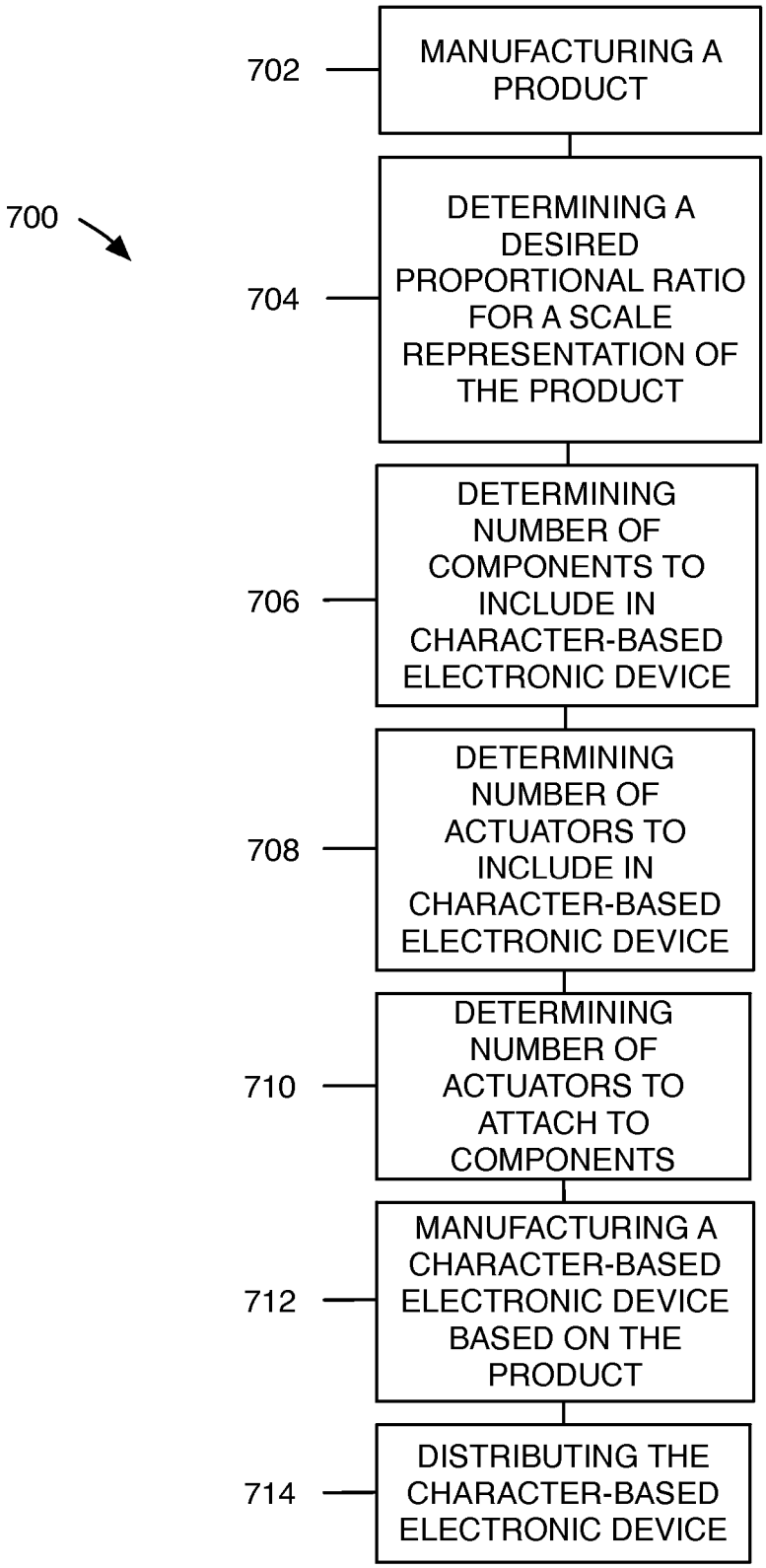
FIG. 12 is a flowchart representation of a method of promoting a product using a character-based electronic device.

FIG. 12 is a flowchart representation of a method of promoting a product 700.

A step 702 comprises manufacturing a product. Another step 704 comprises determining a desired proportional ratio for a scale representation of the product. Another step 706 comprises determining the number of components to include in the character-based electronic device. Another step 708 comprises determining the number of actuators to include in the character-based electronic device. Another step 710 comprises determining the number of actuators to attach to the components included in the character-based electronic device. Another step 712 comprises manufacturing the character-based electronic device based on the product such that the character-based electronic device is a scale representation of the product and includes the components and actuators attached to the components so that actuating a portion of the character-based electronic device activates an actuator and an attached component. Another step 714 comprises distributing the character-based electronic device.

Step 702 can be accomplished using any method of manufacture considered suitable for a particular product.

Step 704 can be accomplished based on a number of considerations, such as the type of product for which a character-based electronic device is being produced, the desired functionality of the character-based electronic device, the number of components to be included in the character-based electronic device, and the number of actuators to be included in the character-based electronic device. A character-based electronic device can be scaled using any suitable proportional ratio, such as those described above with respect to character-based electronic device 604, and any other proportional ratio considered suitable for a particular embodiment.

Step 706 can be accomplished based on a number of considerations, such as the desired functionality of a character-based electronic device, the type of product for which a character-based electronic device is being produced, and the number of actuators to be included in the character-based electronic device. Any suitable number of components can be included in a character-based electronic device, such as one, at least one, two, a plurality, three, four, five, and any other number considered suitable for a particular embodiment. A character-based electronic device can include any suitable component or device, such as those described herein.

Step 708 can be accomplished based on a number of considerations, such as the desired functionality of the character-based electronic device, the type of product for which a character-based electronic device is being produced, and the number of components to be included in the character-based electronic device. Any suitable actuator can be included in the character-based electronic device, such as those described herein. Any suitable number of actuators can be included in a character-based electronic device, such as one, at least one, two, a plurality, three, four, five, and any other number considered suitable for a particular embodiment.

An optional step comprises determining the number of light sources to include in a character-based electronic device. This optional step can be accomplished based on a number of considerations, such as the type of product for which a character-based electronic device is being produced, the desired functionality of the character-based electronic device, the number of components to be included in the character-based electronic device, and the number of actuators to be included in the character-based electronic device. Any suitable light source can be included in the character-based electronic device, such as those described herein. Any suitable number of light sources can be included in a character-based electronic device, such as one, at least one, two, a plurality, three, four, five, and any other number considered suitable for a particular embodiment.

Step 710 can be accomplished as described herein and based on a number of considerations, such as the type of product for which a character-based electronic device is being produced, the desired functionality of the character-based electronic device, the number of components to be included in the character-based electronic device, and the number of actuators to be included in the character-based electronic device. Any suitable number of actuators can be attached to a component in a character-based electronic device, such as one, at least one, two, a plurality, three, four, five, and any other number considered suitable for a particular embodiment.

Step 712 can be accomplished using any method of manufacture considered suitable for a particular character-based electronic device. Any suitable element, feature, and/or structural arrangement described herein with respect to character-based electronic device 10, character-based electronic device 110, character-based electronic device 210, and character-based electronic device 310 can be included in a manufactured character-based electronic device.

Step 714 can be accomplished using any suitable channel of distribution, such as promotional, direct selling, retail, wholesale, direct mail, sales force, telemarketing, cybermarketing, internet marketing, television, cable, and any other channel considered suitable for a particular embodiment.

Figure 13:
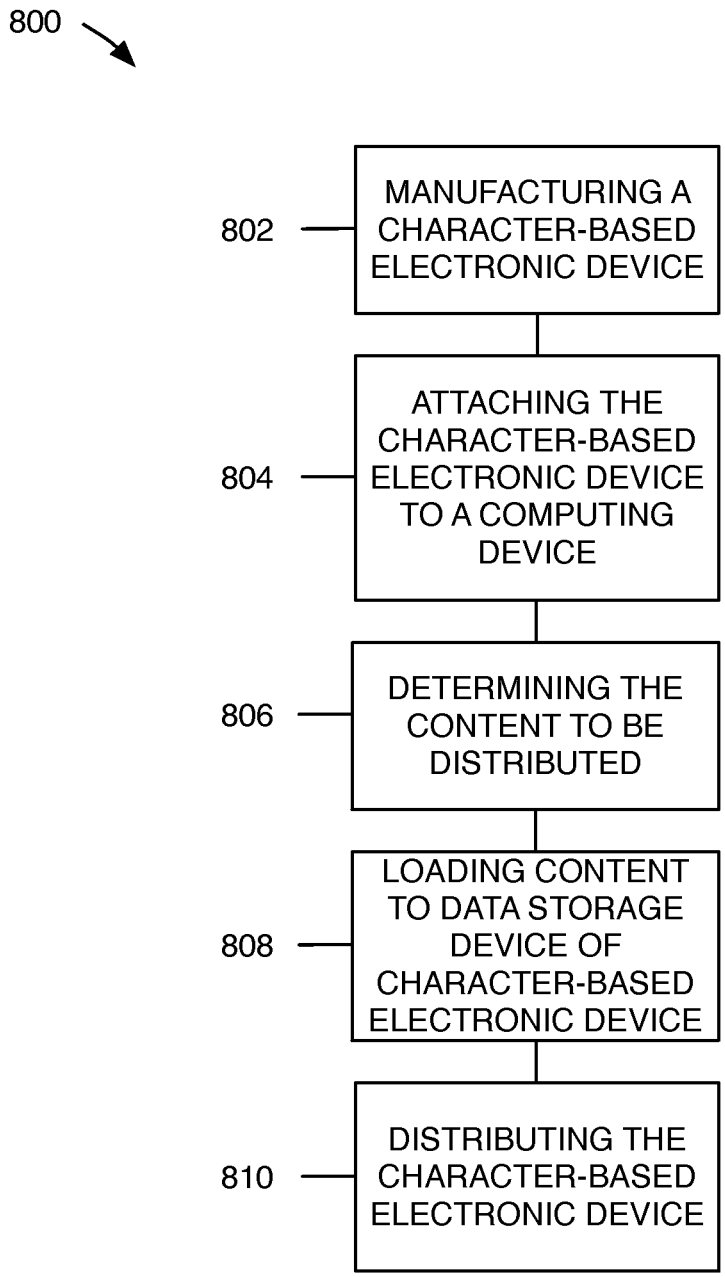
FIG. 13 is a flowchart representation of a method of distributing content using a character-based electronic device.

FIG. 13 is a flowchart representation of a method of distributing content 800.

A step 802 comprises manufacturing a character-based electronic device. Another step 804 comprises attaching the character-based electronic device to a computing device. Another step 806 comprises determining the content to be stored on the character-based electronic device and distributed. Another step 808 comprises loading the content onto a data storage device of the character-based electronic device. Another step 810 comprises distributing the character-based electronic device.

Step 802 can be accomplished using any method of manufacture considered suitable for a particular character-based electronic device. Alternatively, step 802 can omitted from method 800 and an alternative step can be completed that comprises obtaining a previously manufactured character-based electronic device. Any suitable element, feature, and/or structural arrangement described herein with respect to character-based electronic device 10, character-based electronic device 110, character-based electronic device 210, and character-based electronic device 310 can be included in a manufactured character-based electronic device.

An optional step comprises loading an autostart functionality onto a data storage device of the character-based electronic device. An example method considered suitable to accomplish this optional step includes incorporating an autostart file into the data loaded onto a character-based electronic device such that the data is presented (e.g., triggered) once an event has been detected (e.g., power has been activated, actuator has been moved as described herein).

Step 804 can be accomplished using any suitable method of attaching a character-based electronic device to a computing device, such as those described herein. Example methods considered suitable include wirelessly, wired attachment, and any other method of attachment considered suitable for a particular embodiment. An alternative or optional step comprises attaching the character-based electronic device to another character-based electronic device. This alternative or optional step can be accomplished using any suitable method of attaching a character-based electronic device to another character-based electronic device, such as those described herein (e.g., wired, wirelessly).

Step 806 can be accomplished based on a number of considerations, such as the format of the content intended to be distributed, the capacity of the storage devices include in the character-based electronic device, and the size of the content intended to be distributed by the character-based electronic device.

An optional step comprises assigning content to a desired character-based electronic device out of a plurality of character-based electronic devices. For example, if the content is based on data that is based on specific subject matter (e.g., musician, actor, trademark), the content can be assigned to a character-based electronic device that is associated with that particular subject matter (e.g., the character-based electronic device is formed as the musician, actor, trademark).

Step 808 can be accomplished using any suitable method of transferring data from a computing device to the character-based electronic device, such as those described herein. An alternative or optional step comprises loading content to the data storage device of the character-based electronic device from another character-based electronic device. This alternative or optional step can be accomplished using any suitable method of transferring data from a character-based electronic device to another character-based electronic device, such as those described herein.

Step 810 can be accomplished using any suitable method of distribution, such as promotional, direct selling, retail, wholesale, direct mail, sales force, telemarketing, cybermarketing, internet marketing, television, cable, and any other channel considered suitable for a particular embodiment.

The foregoing detailed description includes the best mode for practicing the invention and those with ordinary skill in the art will appreciate that various modifications and alternatives for the described and illustrated embodiments can be developed in light of the overall teachings of the disclosure. Accordingly, the particular arrangements disclosed are intended to be illustrative only and not limiting as to the scope of the invention, which is to be given the full breadth of the appended claims and any and all equivalents thereof.

What is claimed is:

1. A character-based electronic device, comprising:

a housing having at least one wall defining a housing cavity, the housing defining a main body of the character;

a communication bus at least partially disposed within the housing cavity, the communication bus having a plurality of downstream ports;

a head actuator body attached to the housing and configured to move both rotationally and linearly relative to the housing;

an arm actuator body attached to the housing and configured to move rotationally relative to the housing;

a leg actuator body attached to the housing and having an upstream port configured to be placed in electrical communication with an external computing device, the upstream port in electrical communication with the communication bus;

a plurality of electrical components at least partially disposed within the housing cavity and in electrical communication with the downstream ports of the communication bus, each of the components having an on condition and an off condition, the electrical components including a wireless network adaptor, a Bluetooth adapter, and a data storage device;

a first switch attached to the head actuator body and in electrical communication with the communication bus and configured to change the condition of the wireless network adapter upon being actuated by a manual movement of the head actuator body in a first direction to a first position;

a second switch attached to the head actuator body and in electrical communication with the communication bus and configured to change the condition of the Bluetooth adapter upon being actuated by a manual movement of the head actuator body in a second direction to a second position; and a third switch attached to the arm actuator body and in electrical communication with the communication bus and configured to change the condition of the data storage device upon being actuated by a manual movement of the arm actuator body, wherein upon the data storage device being changed to the on condition, a file stored on the data storage device may be accessed by another one of the electrical components or by the external computing device.

2. The character-based electronic device of claim 1, wherein a voice recorder is disposed within the cavity, the voice recorder in electrical communication with the communication bus, the voice recorder having an on condition and an off condition, and the voice recorder connected to a fourth switch attached to the head actuator of the main body.

3. The character-based electronic device of claim 2, wherein a speaker is attached to the housing, and the speaker is in electrical communication with the voice recorder.

4. The character-based electronic device of claim 2, wherein a microphone is attached to the housing, and the microphone is in electrical communication with the voice recorder.

* * * * *